US011903539B2

(12) United States Patent
Miller

(10) Patent No.: US 11,903,539 B2
(45) Date of Patent: Feb. 20, 2024

(54) SURFACE CLEANING APPARATUS WITH PROXIMITY-TRIGGERED USER INTERFACE

(71) Applicant: BISSELL Inc., Grand Rapids, MI (US)

(72) Inventor: David M. Miller, Zeeland, MI (US)

(73) Assignee: BISSELL Inc., Grand Rapids, MI (US)

( * ) Notice: Subject to any disclaimer, the term of this patent is extended or adjusted under 35 U.S.C. 154(b) by 344 days.

(21) Appl. No.: 17/284,962

(22) PCT Filed: Oct. 21, 2019

(86) PCT No.: PCT/US2019/057196

§ 371 (c)(1),
(2) Date: Apr. 13, 2021

(87) PCT Pub. No.: WO2020/082066

PCT Pub. Date: Apr. 23, 2020

(65) Prior Publication Data

US 2021/0244253 A1 Aug. 12, 2021

Related U.S. Application Data

(60) Provisional application No. 62/747,922, filed on Oct. 19, 2018.

(51) Int. Cl.
*A47L 11/40* (2006.01)
*A47L 9/28* (2006.01)
(Continued)

(52) U.S. Cl.
CPC ..... *A47L 11/4011* (2013.01); *A47L 7/0009* (2013.01); *A47L 7/0023* (2013.01); *A47L 9/19* (2013.01); *A47L 9/2826* (2013.01); *A47L 9/2852* (2013.01); *A47L 9/2857* (2013.01); *A47L 9/2873* (2013.01); *A47L 9/2884* (2013.01); *A47L 9/2894* (2013.01); *A47L 9/30* (2013.01); *A47L 11/302* (2013.01);
(Continued)

(58) Field of Classification Search
CPC ... A47L 11/20–2065; A47L 11/29–307; A47L 11/408–4083; A47L 9/28; A47L 9/2805; A47L 9/2857; A47L 9/30
USPC ..... 15/319, 339, 412, 347, 410, 344
See application file for complete search history.

(56) References Cited

U.S. PATENT DOCUMENTS 7,620,476 B2 11/2009 Morse et al.
9,398,836 B2 * 7/2016 Luedke ..... A47L 13/12
(Continued)

FOREIGN PATENT DOCUMENTS

AU 2009201584 A1 4/2009
CN 105559699 A 5/2016
(Continued)

*Primary Examiner* — Tom Rodgers
*Assistant Examiner* — Alberto Saenz
(74) *Attorney, Agent, or Firm* — Warner Norcross + Judd LLP

(57) ABSTRACT

A surface cleaning apparatus includes a proximity-triggered user interface, and configured to provide one or more indicia to a user based on the proximity of the user to the surface cleaning apparatus. The surface cleaning apparatus can be provided with one or more proximity sensors, and the user interface is configured to receive input from the one or more proximity sensors and provide one or more indicia to the user based on the input.

20 Claims, 12 Drawing Sheets

(51) Int. Cl.

| | |
|---|---|
| ***A47L 11/30*** | (2006.01) |
| ***A47L 7/00*** | (2006.01) |
| ***A47L 9/19*** | (2006.01) |
| ***A47L 9/30*** | (2006.01) |
| ***A47L 11/34*** | (2006.01) |

(52) U.S. Cl.
CPC ..... *A47L 11/34* (2013.01); *A47L 11/403* (2013.01); *A47L 11/4005* (2013.01); *A47L 11/4016* (2013.01); *A47L 11/4061* (2013.01); *A47L 11/4083* (2013.01); *A47L 11/4091* (2013.01); *A47L 2201/022* (2013.01)

(56) References Cited

U.S. PATENT DOCUMENTS

| | | | | |
|---|---|---|---|---|
| 10,702,119 | B2 * | 7/2020 | Tran | A47L 7/0009 |
| 2012/0152280 | A1 | 6/2012 | Bosses et al. | |
| 2012/0265343 | A1 * | 10/2012 | Gilbert, Jr. | B60L 15/2036 901/1 |
| 2013/0138247 | A1 * | 5/2013 | Gutmann | G01S 17/06 901/1 |
| 2013/0145572 | A1 | 6/2013 | Schregardus et al. | |
| 2014/0196248 | A1 * | 7/2014 | Morgan | A47L 9/00 55/357 |
| 2015/0035432 | A1 * | 2/2015 | Kendall | F25D 27/005 315/76 |
| 2016/0174035 | A1 | 6/2016 | Hughes et al. | |
| 2017/0119225 | A1 | 5/2017 | Xia et al. | |
| 2018/0008112 | A1 * | 1/2018 | Ham | A47L 9/2857 |
| 2018/0299902 | A1 | 4/2018 | Hillen | |
| 2018/0247124 | A1 | 8/2018 | Ha et al. | |
| 2018/0249875 | A1 | 9/2018 | Hooley et al. | |

FOREIGN PATENT DOCUMENTS

| | | | | |
|---|---|---|---|---|
| CN | 106829258 | A | 6/2017 | |
| JP | 2018112917 | A | 7/2018 | |
| WO | 2009049699 | A1 | 4/2009 | |
| WO | WO-2018153281 | A1 * | 8/2018 | A47L 5/12 |

* cited by examiner

SURFACE CLEANING APPARATUS WITH PROXIMITY-TRIGGERED USER INTERFACE

CROSS-REFERENCE TO RELATED APPLICATIONS

This application is the U.S. National Stage of International Application No. PCT/US2019/057196 filed on Oct. 21, 2019, which claims the benefit of U.S. Provisional Patent Application No. 62/747,922 filed Oct. 19, 2018, both of which are incorporated herein by reference in their entirety.

BACKGROUND

Surface cleaning apparatus for cleaning floor surfaces sometimes include fluid recovery systems that extract fluid and debris (which may include dirt, dust, stains, soil, hair, and other debris) from the surface. The fluid recovery system typically includes a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. The recovery tank is periodically emptied of collected fluid and debris, such as by removing the recovery tank from the apparatus and pouring the collected fluid and debris into a sink, toilet, or other drain.

Some surface cleaning apparatus also include a fluid delivery system that delivers cleaning fluid to a surface to be cleaned. Multi-surface vacuum cleaners are adapted for cleaning hard floor surfaces such as tile and hardwood and soft floor surfaces such as carpet and upholstery, and can include fluid delivery and recovery systems. Other multi-surface cleaning apparatuses include "dry" vacuum cleaners which can clean different surface types, but do not dispense or recover fluid.

BRIEF SUMMARY

According to one aspect of the disclosure, a surface cleaning apparatus includes a proximity-triggered user interface.

According to another aspect of the disclosure, a surface cleaning apparatus is provided with a user interface configured to provide one or more indicia to the user based on the proximity of the user to the surface cleaning apparatus.

According to another aspect of the disclosure, a surface cleaning apparatus is provided with one or more proximity sensors and a user interface configured to receive input from the one or more proximity sensors and provide one or more indicia to the user based on the input.

According to another aspect of the disclosure, a surface cleaning apparatus is provided with a controller operably coupled with the various function systems of the apparatus for controlling its operation and at least one user interface through which a user of the apparatus interacts with the controller, one or more proximity sensors operably coupled with the controller and configured to detect the presence of a nearby user without any physical contact, and a user interface configured to receive input from the controller and provide one or more indicia to the user based on the input.

In any of the above aspects of the disclosure, the user interface can includes a human-machine interface (HMI) operably connected to systems in the apparatus to affect and control its operation and a status user interface (SUI) having at least one status indicator which communicates a condition or status of the apparatus to the user. The HMI and the SUI can be provided as separate interfaces or can be integrated with each other, such as in a composite user interface, graphical user interface, or multimedia user interface.

These and other features and advantages of the present disclosure will become apparent from the following description of particular embodiments, when viewed in accordance with the accompanying drawings and appended claims.

DETAILED DESCRIPTION

Figure 1:
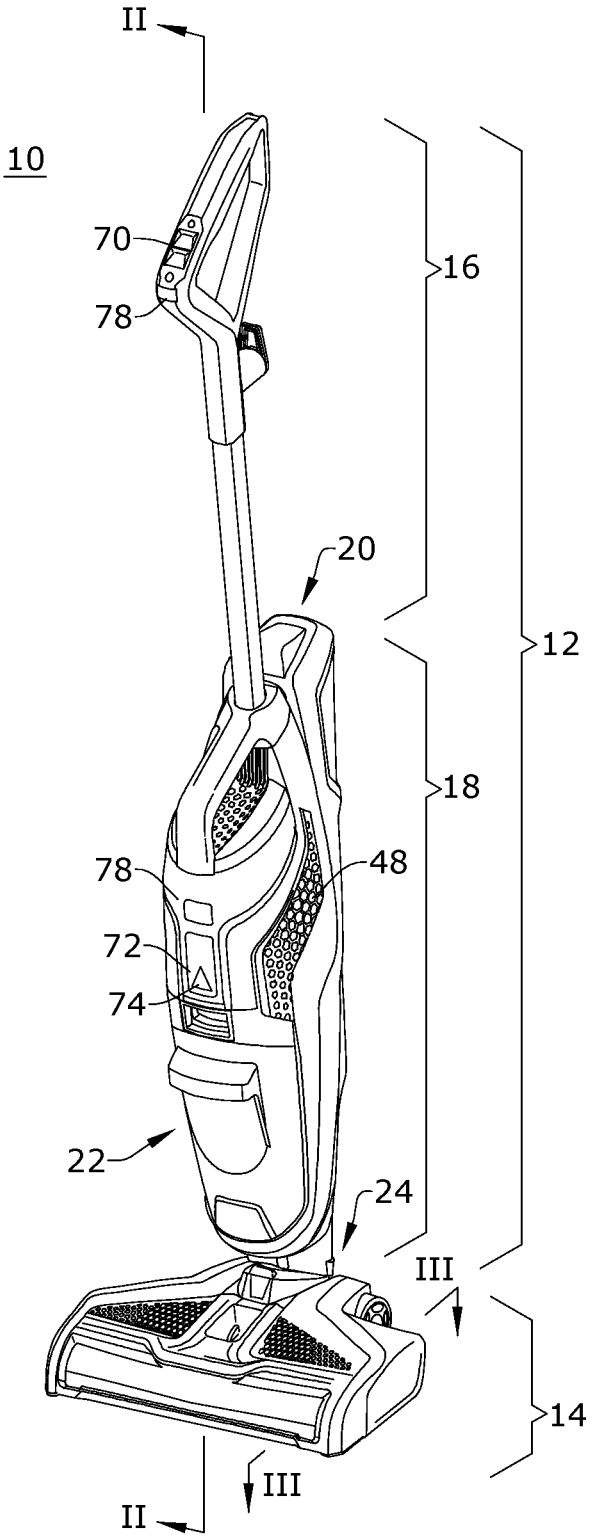
FIG. 1 is a perspective view of a surface cleaning apparatus according to one aspect of the disclosure.

Aspects of the disclosure generally relates to a surface cleaning apparatus. In particular, aspects relate to an improved user interface for a surface cleaning apparatus.

According to one aspect, a surface cleaning apparatus is provided with a proximity-triggered user interface.

According to another aspect, a surface cleaning apparatus is provided with a user interface configured to provide one or more indicia to the user based on the proximity of the user to the surface cleaning apparatus.

According to another aspect, a surface cleaning apparatus is provided with one or more proximity sensors and a user interface configured to receive input from the one or more proximity sensors and provide one or more indicia to the user based on the input.

The functional systems of the surface cleaning apparatus can be arranged into any desired configuration, such as an upright device having a base and an upright body for directing the base across the surface to be cleaned, a canister device having a cleaning implement connected to a wheeled base by a vacuum hose, a portable device adapted to be hand carried by a user for cleaning relatively small areas, an autonomous or robotic device, or a commercial device. Any of the aforementioned cleaners can be adapted to include a flexible vacuum hose, which can form a portion of the working air conduit between a nozzle and the suction source. The surface cleaning apparatus may specifically be in the form of a multi-surface wet vacuum cleaner. As used herein, the term "multi-surface wet vacuum cleaner" includes a vacuum cleaner that can be used to clean hard floor surfaces such as tile and hardwood and soft floor surfaces such as carpet.

The surface cleaning apparatus can include at least a recovery system for removing the spent cleaning fluid (e.g. liquid) and debris from the surface to be cleaned and storing the spent cleaning fluid and debris. The surface cleaning apparatus can optionally further include a fluid delivery system for storing cleaning fluid (e.g. liquid) and delivering the cleaning fluid to the surface to be cleaned. Aspects of the disclosure may also be incorporated into a steam apparatus, such as surface cleaning apparatus with steam delivery. Aspects of the disclosure may also be incorporated into an apparatus with only recovery capabilities, such as surface cleaning apparatus without fluid delivery.

The surface cleaning apparatus can include a controller operably coupled with the various functional systems of the apparatus for controlling its operation and at least one user interface through which a user of the apparatus interacts with the controller. The controller is operably coupled with the at least one user interface for receiving inputs from a user, and can further be operably coupled with at least one sensor for receiving input about the environment and can use the sensor input to control the operation of the surface cleaning apparatus.

For example, the controller can be operably coupled with at least one proximity sensor configured to detect the presence of a nearby user without any physical contact. The controller can use the proximity sensor input to provide one or more indicia about the status of the apparatus to the user via the user interface. The indicia may be visual or audible.

FIG. 1 is a perspective view of a surface cleaning apparatus 10 according to one aspect of the present disclosure. As discussed in further detail below, the surface cleaning apparatus 10 is provided with a proximity-triggered user interface, including one or more status indicators which communicate information regarding the apparatus 10 to the user based on the proximity of the user. One example of a suitable surface cleaning apparatus in which the various features and improvements described herein can be used is disclosed in U.S. Patent Application Publication No. 2017/0119225, published May 4, 2017, which is incorporated herein by reference in its entirety.

As illustrated herein, the surface cleaning apparatus 10 is an upright multi-surface wet vacuum cleaner having a housing that includes an upright body or handle assembly 12 and a cleaning head or base 14 mounted to or coupled with the upright handle assembly 12 and adapted for movement across a surface to be cleaned. For purposes of description related to the figures, the terms "upper," "lower," "right," "left," "rear," "front," "vertical," "horizontal," "inner," "outer," and derivatives thereof shall relate to the disclosure as oriented in FIG. 1 from the perspective of a user behind the surface cleaning apparatus 10, which defines the rear of the surface cleaning apparatus 10. However, it is to be understood that the disclosure may assume various alternative orientations, except where expressly specified to the contrary.

The upright handle assembly 12 comprises an upper handle 16 and a frame 18. Frame 18 comprises a main support section or body assembly supporting at least a supply tank assembly 20 and a recovery tank assembly 22, and may further support additional components of the handle assembly 12. The surface cleaning apparatus 10 can include a fluid delivery or supply pathway, including and at least partially defined by the supply tank assembly 20, for storing cleaning fluid and delivering the cleaning fluid to the surface to be cleaned and a fluid recovery pathway, including and at least partially defined by the recovery tank assembly 22, for removing the spent cleaning fluid and debris from the surface to be cleaned and storing the spent cleaning fluid and debris until emptied by the user.

A moveable joint assembly 24 can be formed at a lower end of the frame 18 and moveably mounts the base 14 to the upright assembly 12. In the embodiment shown herein, the base 14 can pivot up and down about at least one axis relative to the upright assembly 12. The joint assembly 24 can alternatively comprise a universal joint, such that the base 14 can pivot about at least two axes relative to the upright assembly 12. Wiring and/or conduits can optionally supplying air and/or liquid (or other fluids) between the base 14 and the upright assembly 12, or vice versa, can extend though the swivel joint assembly 24. A locking mechanism (not shown) can be provided to lock the joint assembly 24 against movement about at least one of the axes of the joint assembly 24.

The surface cleaning apparatus 10 can include at least one user interface through which a user can interact with the surface cleaning apparatus 10. The at least one user interface can enable operation and control of the apparatus 10 from the user's end, and can also provide feedback information from the apparatus 10 to the user. The at least one user interface can be electrically coupled with electrical components, including, but not limited to, circuitry electrically connected to various components of the fluid delivery and recovery systems of the surface cleaning apparatus 10.

In the illustrated embodiment, the user interface of the surface cleaning apparatus 10 includes a human-machine interface (HMI) 70 having one or more input controls, such as but not limited to buttons, triggers, toggles, keys, switches, or the like, operably connected to systems in the apparatus 10 to affect and control its operation. The user interface of the surface cleaning apparatus 10 also includes a status user interface (SUI) 72 having at least one status indicator 74 which communicates a condition or status of the apparatus 10 to the user. The at least one status indicator 74 can communicate visually and/or audibly. The HMI 70 and the SUI 72 can be provided as separate interfaces or can be integrated with each other, such as in a composite user interface, graphical user interface, or multimedia user interface.

The surface cleaning apparatus 10 can further include a controller 76 (FIGS. 2 and 7) operably coupled with the various function systems of the apparatus 10 for controlling its operation. The controller 76 is operably coupled with the HMI 70 for receiving inputs from a user and with the SUI 72 for providing one or more indicia about the status of the apparatus 10 to the user via the at least one status indicator 74, and can further be operably coupled with at least one sensor for receiving input about the environment and can use the sensor input to control the operation of the surface cleaning apparatus 10. For example, the controller 76 can be operably coupled with at least one proximity sensor 78 configured to detect the presence of a nearby user without any physical contact. In other words, a user need to physically touch the apparatus 10, including its housing, or the proximity sensor 78 for the user's presence to be registered by the controller 76. The at least one proximity sensor 78 can comprise any suitable configuration, including electromagnetic, ultrasonic, optical, or acoustic, for example. Examples of suitable proximity sensors include passive infrared (PIR) proximity sensors, microwave proximity sensors, ultrasonic proximity sensors, or photoelectric sensors.

The at least one proximity sensor 78 can transmit data either through a wired connection or wirelessly. In an exemplary arrangement, the at least one proximity sensor 78 has a wired connection with the controller 76, and transmits proximity data via the wired connection to the controller 76. The controller 76 can use the proximity sensor input to provide one or more indicia about the status of the apparatus 10 to the user via the SUI 72.

Figure 2:
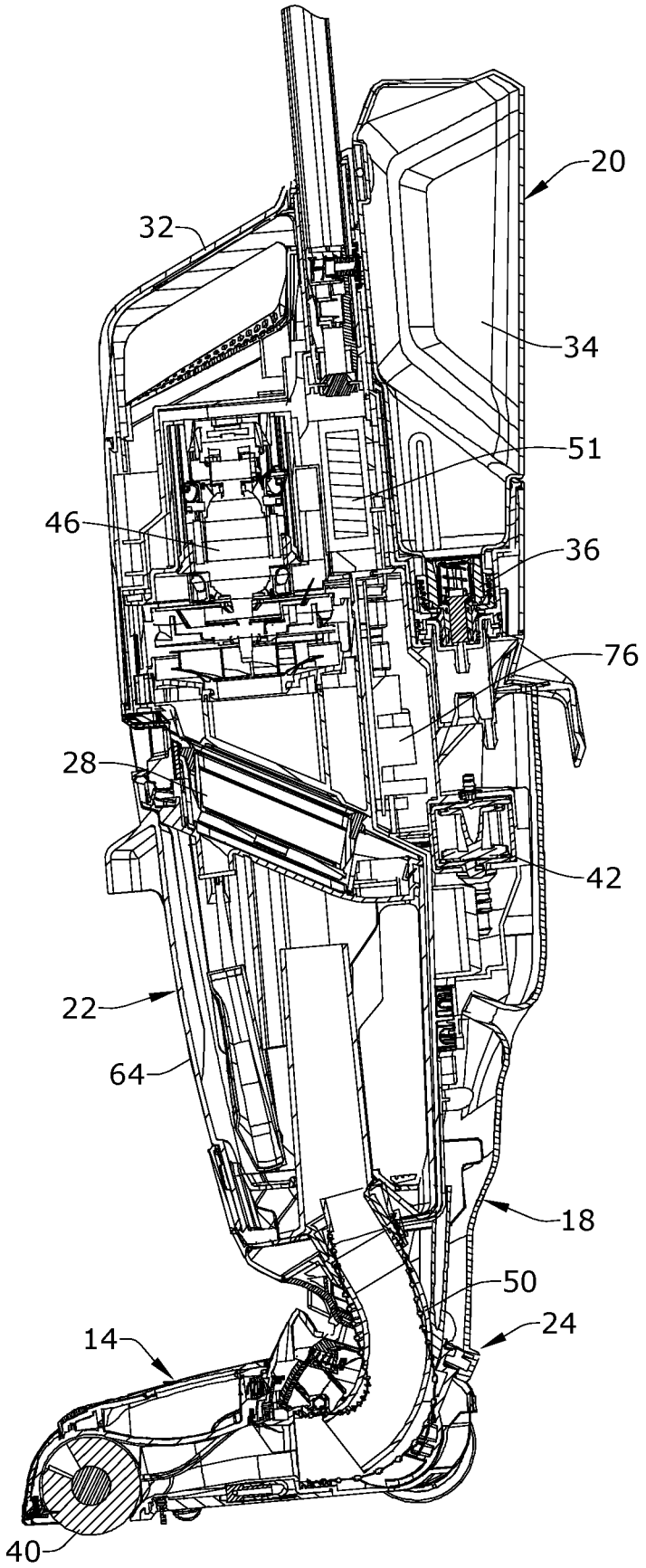
FIG. 2 is a cross-sectional view of the surface cleaning apparatus taken through line II-II of FIG. 1.

In one example, the controller 76 can comprise a microcontroller (MCU), and can be located in the upright handle assembly 12, such as in the frame 18 as shown in FIG. 2. In the embodiment shown, the controller 76 is in operable communication with but separate from the HMI 70 and the SUI 72. In other embodiments, the controller 76 can be integrated with the HMI 70 or the SUI 72.

With reference to FIG. 1, in the embodiment shown, the HMI 70 and the SUI 72 are physically separate from each other. The HMI 70 in particular is on the handgrip 26, while the SUI 72 is on the frame 18. In other embodiments, the SUI 72, particularly the status indicators 74, can be directly adjacent the HMI 70 or can be integrated with the HMI 70, such as in a composite user interface, graphical user interface, or multimedia user interface. In either alternative, the HMI 70 may be provided elsewhere on the apparatus 10, such as on the frame 18.

The at least one proximity sensor 78 has a field of view and working range, which together defines a detection zone for the surface cleaning apparatus 10. The at least one proximity sensor 78 can be located anywhere on the housing of the apparatus 10, including on the upright handle assembly 12 or base 14, to define a detection zone covering an area exterior of the housing to detect users approaching the apparatus 10. The detection zone can be configured to cover at least the front of the surface cleaning apparatus 10, and can include at least one proximity sensor 78 with a field of view of up to 180 degrees. Further, the detection zone can be configured to cover at least the front and sides of the surface cleaning apparatus and can include at least one proximity sensor 78 with a field of view of up to 180 degrees, or greater than 180 degrees, including up to 270 degrees. Still further, the detection zone can be configured to cover the front, sides, and rear of the surface cleaning apparatus 10, and can include at least one proximity sensor 78 with a field of view of 360 degrees. In embodiments where multiple proximity sensors 78 are provided, each sensor can have a field of view which collectively define the detection zone, and the fields may be disparate or overlapping. Multiple proximity sensors 78 can be employed to provide a detection zone with the coverages described above. For any of these exemplary detection zones, the working range of the at least proximity sensor 78 can, for example, be at least 2 feet, at least 6 feet, and distances therebetween.

In one example, at least one proximity sensor 78 can be located in the handgrip 26, with a field of view facing generally forward, and/or at least one proximity sensor 78 can be located in the frame 18, such as in an upper portion of the main support section or body assembly, with a field of view facing generally forward. In this example, the detection zone for the surface cleaning apparatus 10, whether one or both of the sensors 78 are included, cover at least the front of the apparatus 10, as well as a portion of the sides of the apparatus 10, and can be approximately 180 degrees or greater than 180 degrees. Such a detection zone detects the presence of a nearby user approaching from the front or sides of the apparatus 10. Various other locations for the at least one proximity sensor 78 are possible, such as in the base 14, elsewhere on the handle 16, or elsewhere on the frame 18.

FIG. 2 is a cross-sectional view of the surface cleaning apparatus 10 through line II-II FIG. 1. The upper handle 16 can include a handgrip 26 and the HMI 70. In other embodiments, the HMI 70 can be provided elsewhere on the surface cleaning apparatus 10, such as on the frame 18. In the present example, a trigger 30 is mounted to the handgrip 26 and operably communicates with the fluid delivery system to control fluid delivery from the surface cleaning apparatus 10. Other actuators, such as a thumb switch, can be provided instead of the trigger 30. A carry handle 32 can be disposed on the frame 18, forwardly of the handle 16, at an angle to facilitate manual lifting and carrying of the surface cleaning apparatus 10.

The supply tank assembly 20 can be mounted to the frame 18 in any configuration. In the present example, the supply tank assembly 20 is removably mounted to a housing of the frame 18 such that the supply tank assembly 20 partially rests in the upper rear portion of the frame 18 and can be removed for filling.

The recovery tank assembly 22 can be mounted to the frame 18 in any configuration. In the present example, the recovery tank assembly 22 is removably mounted to the front of the frame 18, below the supply tank assembly 20, and can be removed for emptying.

The fluid delivery system is configured to deliver cleaning fluid from the supply tank assembly 20 to a surface to be cleaned, and can include, as briefly discussed above, a fluid delivery or supply pathway. The cleaning fluid can comprise one or more of any suitable cleaning fluids, including, but not limited to, water, compositions, concentrated detergent, diluted detergent, etc., and mixtures thereof. For example, the fluid can comprise a mixture of water and concentrated detergent.

The supply tank assembly 20 includes at least one supply chamber 34 for holding cleaning fluid and a supply valve assembly 36 controlling fluid flow through an outlet of the supply chamber 34. Alternatively, supply tank assembly 20 can include multiple supply chambers, such as one chamber containing water and another chamber containing a cleaning agent.

For a removable supply tank assembly 20, the supply valve assembly 36 can mate with a receiving assembly on the frame 18 and can be configured to automatically open when the supply tank assembly 20 is seated on the frame 18 to release fluid to the fluid delivery pathway.

In addition to the supply tank assembly 20, the fluid delivery pathway can include a fluid distributor 38 (FIG. 3) having at least one outlet for applying the cleaning fluid to the surface to be cleaned. In one embodiment, the fluid distributor 38 can be one or more spray tips on the base 14 configured to deliver cleaning fluid to the surface to be cleaned directly or indirectly by spraying a brushroll 40. Other embodiments of fluid distributors 38 are possible, such as a spray manifold having multiple outlets or a spray nozzle configured to spray cleaning fluid outwardly from the base 14 in front of the surface cleaning apparatus 10.

The fluid delivery system can further comprise a flow control system for controlling the flow of fluid from the supply tank assembly 20 to the fluid distributor 38. In one configuration, the flow control system can comprise a pump 42 which pressurizes the system. The trigger 30 can be operably coupled with the flow control system such that pressing the trigger 30 will deliver fluid from the fluid distributor 38. The pump 42 can be positioned within a housing of the frame 18, and in the illustrated embodiment the pump 42 is beneath and in fluid communication with the supply tank assembly 20 via the valve assembly 36. In one example, the pump 42 can be a centrifugal pump. In another example, the pump 42 can be a solenoid pump having a single, dual, or variable speed.

In another configuration of the fluid supply pathway, the pump 42 can be eliminated and the flow control system can comprise a gravity-feed system having a valve fluidly coupled with an outlet of the supply tank assembly 20, whereby when valve is open, fluid will flow under the force of gravity to the fluid distributor 38.

Optionally, a heater (not shown) can be provided for heating the cleaning fluid prior to delivering the cleaning fluid to the surface to be cleaned. In one example, an in-line heater can be located downstream of the supply tank assembly 20, and upstream or downstream of the pump 42. Other types of heaters can also be used. In yet another example, the cleaning fluid can be heated using exhaust air from a motor-cooling pathway for a suction source of the recovery system.

The recovery system is configured to remove spent cleaning fluid and debris from the surface to be cleaned and store the spent cleaning fluid and debris on the surface cleaning apparatus 10 for later disposal, and can include, as briefly discussed above, a fluid recovery pathway. The fluid recovery pathway can include at least a dirty inlet and a clean outlet. The pathway can be formed by, among other elements, a suction nozzle 44 defining the dirty inlet, a suction source 46 in fluid communication with the suction nozzle 44 for generating a working air stream, the recovery tank assembly 22, and exhaust vents 48 (FIG. 1) defining the clean air outlet. In the illustrated example, the recovery tank assembly 22 comprises a recovery tank container 64, which forms the collection container for the fluid recovery system.

The suction nozzle 44 can be provided on the base 14 can be adapted to be adjacent the surface to be cleaned as the base 14 moves across a surface. The brushroll 40 can be provided adjacent to the suction nozzle 44 for agitating the surface to be cleaned so that the debris is more easily ingested into the suction nozzle 44. The suction nozzle 44 is further in fluid communication with the recovery tank assembly 22 through a flexible conduit 50. The flexible conduit 50 can pass through the joint assembly 24.

The suction source 46, which may be a motor/fan assembly 46, is provided in fluid communication with the recovery tank assembly 22. The motor/fan assembly 46 can be positioned within a housing of the frame 18, such as above the recovery tank assembly 22 and forwardly of the supply tank assembly 20. The recovery system can also be provided with one or more additional filters upstream or downstream of the motor/fan assembly 46. For example, in the illustrated embodiment, a pre-motor filter 28 is provided in the working air path downstream of the recovery tank assembly 22 and upstream of the motor/fan assembly.

Electrical components of the surface cleaning apparatus 10, including the motor/fan assembly 46, the pump 42, and a drive motor for the brushroll 40, can be electrically coupled to a power source 51, such as a battery or a power cord plugged into a household outlet. In one exemplary arrangement, the power source 51 may comprise a user replaceable battery. In another exemplary arrangement the power source 51 may comprise a rechargeable battery. In one example, the battery 51 can be a lithium ion battery.

The HMI 70 can include one or more switches for controlling actuation of the motor/fan assembly 46, the brushroll 40, and/or the pump 42. In one example, the HMI 70 can be provided with actuators for selecting between multiple cleaning modes. For instance, the surface cleaning apparatus 10 can have at least a hard floor cleaning mode, a carpet cleaning mode, and a self-cleaning mode.

Figure 3:
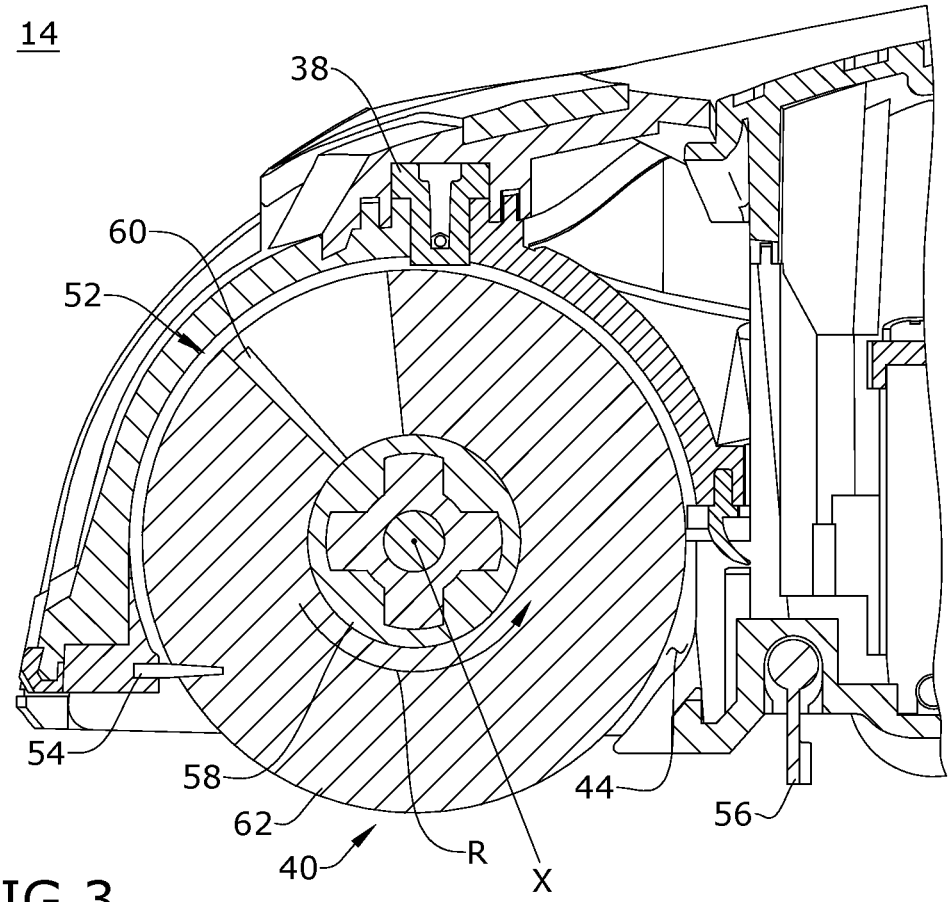
FIG. 3 is a sectional view through a portion a base of the surface cleaning apparatus taken through line III-Ill of FIG. 1.

FIG. 3 is a close-up sectional view through a forward section of the base 14. The brushroll 40 can be provided at a forward portion of the base 14 and received in a brush chamber 52 on the base 14. The brushroll 40 is positioned for rotational movement in a direction R about a central rotational axis X. The base 14 includes the suction nozzle 44 that is in fluid communication with the flexible conduit 50 (FIG. 2) and which is defined within the brush chamber 52. In the present embodiment the suction nozzle 44 is configured to extract fluid and debris from the brushroll 40 and from the surface to be cleaned.

In the example embodiment, the brushroll 40 can be operably coupled to and driven by a drive assembly including a dedicated brush motor 53 (FIG. 7) in the base 14. Alternatively, the motor/fan assembly 46 can provide both vacuum suction and brushroll rotation.

The fluid distributor 38 of the present embodiment includes multiple spray tips, though only one spray tip is visible in FIG. 3, which are mounted to the base 14 with an outlet in the brush chamber 52 and oriented to spray fluid inwardly onto the brushroll 40.

A front interference wiper 54 is mounted at a forward portion of the brush chamber 52 and is configured to interface with a leading portion of the brushroll 40, as defined by the direction of rotation R of the brushroll 40. The interference wiper 54 is below the fluid distributor 38, such that the wetted portion brushroll 40 rotates past the interference wiper 54, which scrapes excess fluid off the brushroll 40, before reaching the surface to be cleaned.

A rear squeegee 56 is mounted to the base 14 behind the brushroll 40 and the brush chamber 52 and is configured to contact the surface as the base 14 moves across the surface to be cleaned. The rear squeegee 56 wipes residual fluid from the surface to be cleaned so that it can be drawn into the fluid recovery pathway via the suction nozzle 44, thereby leaving a moisture and streak-free finish on the surface to be cleaned.

In the present example, brushroll 40 can be a hybrid brushroll suitable for use on both hard and soft surfaces, and for wet or dry vacuum cleaning. In one embodiment, the brushroll 40 comprises a dowel 58, a plurality of bristles 60 extending from the dowel 58, and microfiber material 62 provided on the dowel 58 and arranged between the bristles 60. One example of a suitable hybrid brushroll is disclosed in U.S. Patent Application Publication No. 2017/0119225, incorporated above.

Figure 4:
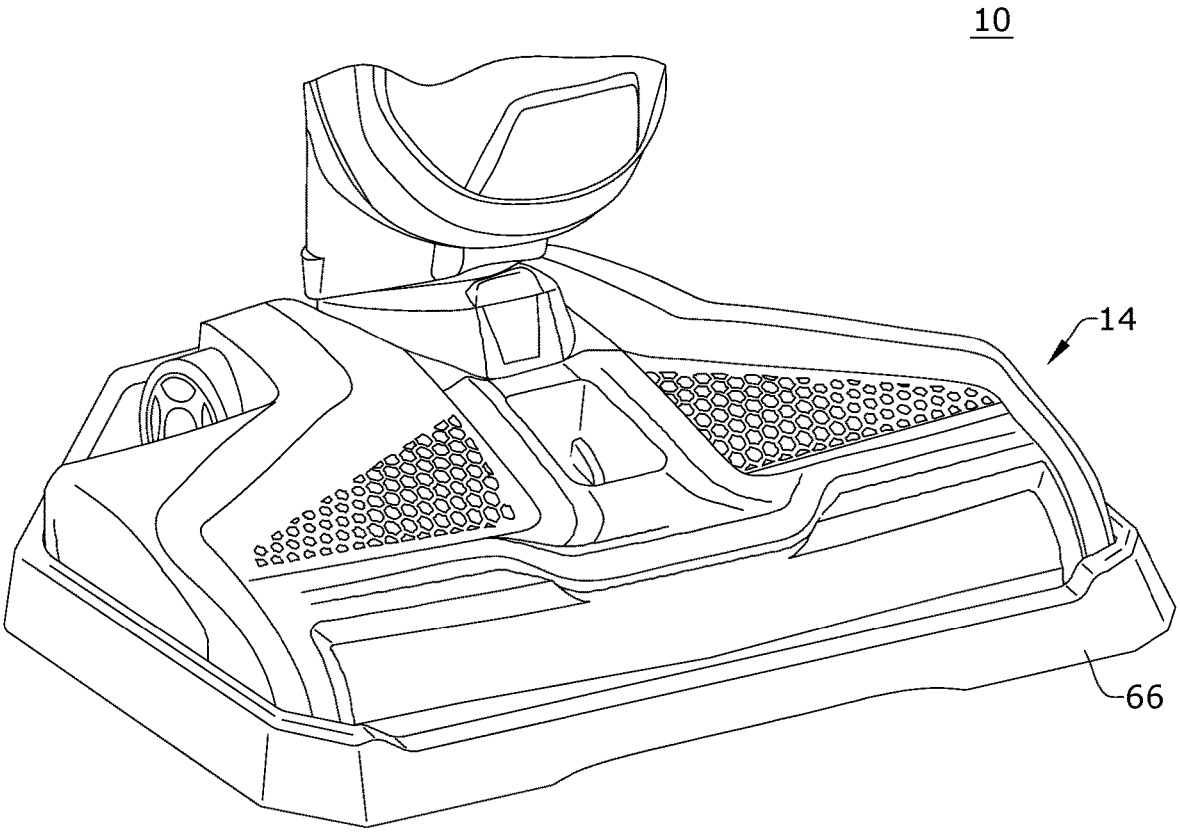
FIG. 4 is a perspective view of the surface cleaning apparatus of FIG. 1 docked in a storage tray.

Referring to FIG. 4, the surface cleaning apparatus 10 can optionally be provided with a storage tray 66 that can be used when storing the apparatus 10. The storage tray 66 can be configured to receive the base 14 of the apparatus 10 in an upright, stored position. The storage tray 66 can further be configured for further functionality beyond simple storage, such as for charging the apparatus 10 and/or for self-cleaning of the apparatus 10.

In one embodiment of the storage tray 66, the storage tray 66 can be a docking station configured to charge the battery 51. The storage tray 66 can optionally having charging contacts, and corresponding charging contacts can be provided on the exterior of the apparatus 10, such as on the exterior of the base 14. When operation has ceased, the apparatus 10 can be locked upright and placed into the storage tray 66 for recharging the battery 51.

In another embodiment of the storage tray 66, the storage tray 66 can be used during a self-cleaning mode of the apparatus 10, which can be used to clean one or more components of the recovery system and/or the fluid delivery system, such as the brushroll 40 and internal components of the fluid recovery pathway of apparatus 10. The storage tray 66 can optionally be adapted to contain a liquid for the purposes of cleaning the interior parts of apparatus 10 and/or receiving liquid that may leak from the supply tank assembly 20 while the apparatus 10 is not in active operation. When operation has ceased, the apparatus 10 can be locked upright and placed into the storage tray 66 for cleaning. The apparatus 10 is prepared for self-cleaning by coupling the apparatus 10 to the power source 51 and filling the storage tray 66 to a predesignated fill level with a cleaning liquid, such as water. The user can select the self-cleaning mode via the HMI 70. In one example, during the self-cleaning mode, the suction source 46 and the brush motor 53 are activated, which draws cleaning liquid in the storage tray 66 into the fluid recovery pathway. The self-cleaning mode can be configured to last for a predetermined amount of time or until the cleaning liquid in storage tray 66 has been depleted.

Figure 5:
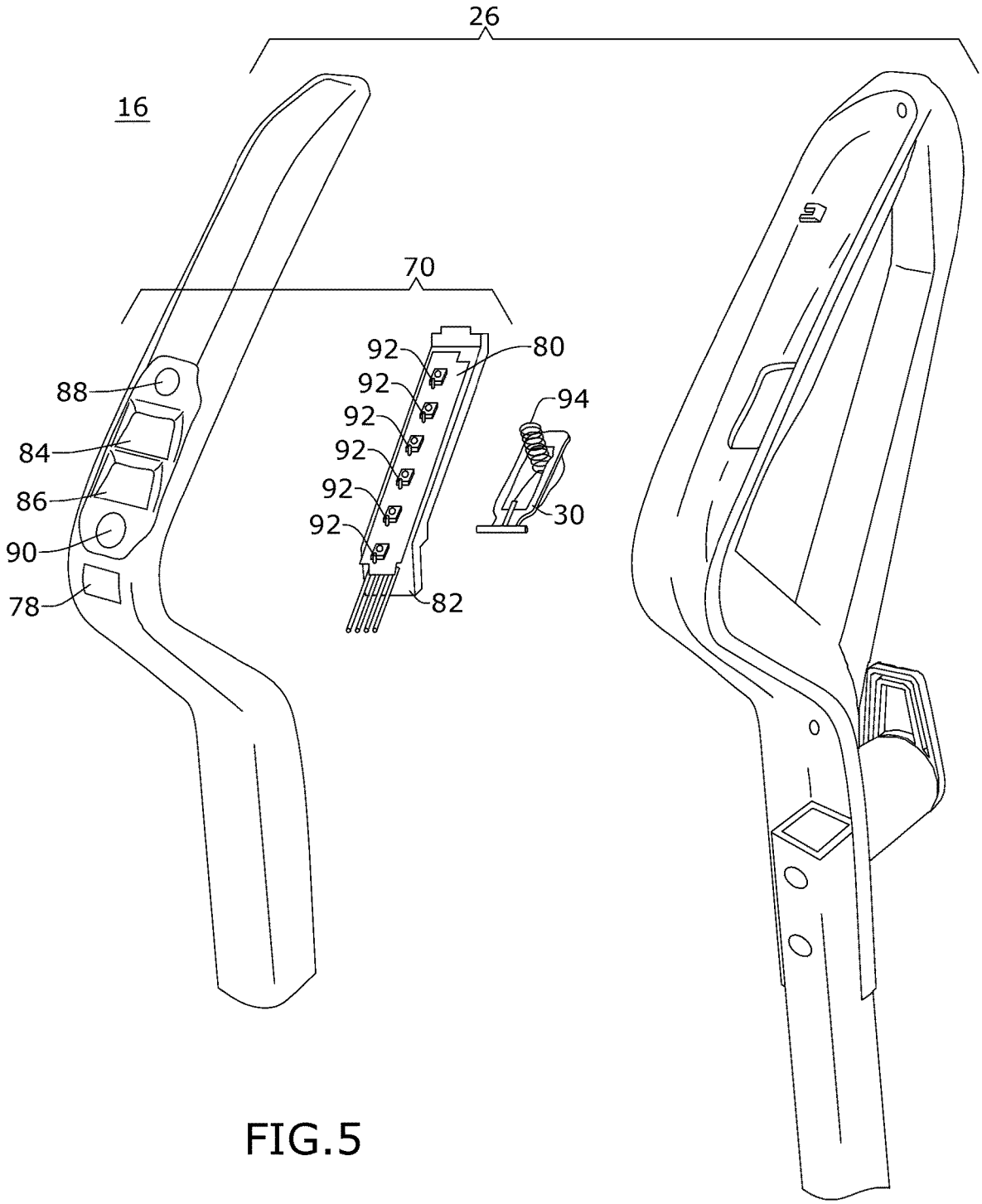
FIG. 5 is a partially exploded view of a handle of the surface cleaning apparatus, showing one embodiment of a human-machine interface (HMI) for the surface cleaning apparatus.

FIG. 5 is an exploded perspective view of the handle 16 of the surface cleaning apparatus 10, showing one embodiment of the HMI 70 for the surface cleaning apparatus 10. The HMI 70 as shown herein is provided at a front side of the handgrip 26. In one embodiment, the HMI 70 can include a printed circuit board (PCB) assembly 80 coupled to the handgrip 26 by a bracket 82. One or more input controls 84, 86, 88, 90 in register with the PCB assembly 80 are provided on an exterior of the handgrip 26 for user access. The input controls 84, 86, 88, 90 can be configured to provide power to one or more electrical components of the apparatus 10, including the suction source 46, the brush motor 53, and the pump 42, in various combinations. A waterproof seal (not shown) can optionally be provided around the PCB assembly 80 to protect the PCB assembly 80 from liquid ingress.

In one embodiment, one input control 84 initiates a hard floor cleaning mode, one input control 86 initiates a carpet cleaning mode, one input control 88 initiates the self-cleaning mode, and one input control 90 controls the power supply to the SUI 72, as described in further detail below. In one example of a hard floor cleaning mode, the suction source 46, the brush motor 53, and the pump 42 are powered, with the pump 42 operating at a first flow rate. In the carpet cleaning mode, the suction source 46, the brush motor 53, and the pump 42 are powered, with the pump 42 operating at a second flow rate which is greater than the first flow rate.

One or more of the input controls 84, 86, 88, 90 can comprise a button, trigger, toggle, key, switch, or the like, or any combination thereof In one example, one or more of the input controls 84, 86, 88, 90 can comprise a capacitive button.

Optionally, the HMI 70 can include at least one light source 92 that emits light. For example, the PCB assembly 80 can include at least one light-emitting diode (LED); as shown herein, the PCB assembly 80 can include at least one LED array.

The trigger 30 can be provided on a rear side of the handgrip 26, opposite the HMI 70, and can project at least partially exteriorly of the handgrip 26 for use access. A spring 94 can bias the trigger 30 outwardly from the handgrip 26. The trigger 30 can electronically communicate with the fluid delivery system. Alternatively, the trigger 30 can mechanically communicate with the fluid delivery system, such as via a push rod (not shown) that runs through the upper handle 16.

Figure 6:
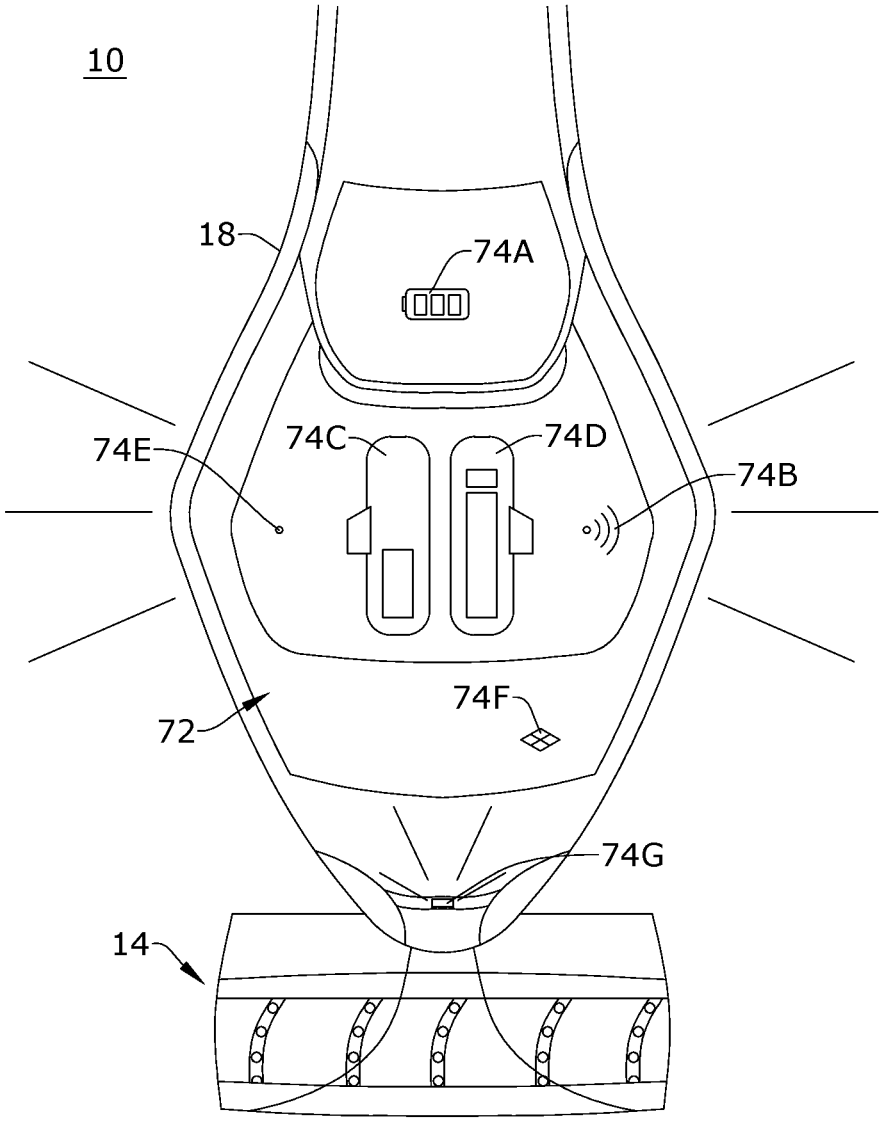
FIG. 6 is a close-up front view of a portion of the surface cleaning apparatus, showing one embodiment of a status user interface (SUI) for the surface cleaning apparatus.

FIG. 6 is a front view of the surface cleaning apparatus 10, showing one embodiment of the SUI 72 for the surface cleaning apparatus 10. The SUI 72 as shown herein is provided at a front side of the frame 18, below the handle 16 and above the base 14. In one embodiment, the SUI 72 can include multiple status indicators 74 which can display various detailed apparatus status information such as, but not limited to, battery status, Wi-Fi connection status, clean water level, dirty water level, filter status, floor type, self-cleaning, or any number of other status information.

The status indicators 74 can be visual displays for conveying the status of a component of the apparatus 10. The visual display may include any of a variety of lights, such as light-emitting diodes (LEDs), textual displays, graphical displays, or any variety of known status indicators.

In one exemplary arrangement, the SUI 72 can comprise an LED flexible matrix display. The flexible matrix display can, for example, include a printed circuit board (PCB), an isolator, a diffuser, a masking surface, and a decorative layer. In the embodiment shown, the flexible matrix display is provided on a front side of the frame 18. The SUI 72 can further have an opaque molded plastic part or trim component which encloses and protects portions of the flexible matrix display.

In the embodiment shown in FIG. 6, the SUI 72 can include a battery status indicator 74A, a Wi-Fi connection status indicator 74B, a clean water level status indicator 74C, a dirty water level status indicator 74D, a filter status indicator 74E, a floor type status indicator 74F, and a self-cleaning status indicator 74G.

The battery status indicator 74A can convey the amount of charge left within the battery 51. In the illustrated example, the battery status indicator 74A includes a battery graphic with three light-emitting diodes, which signal a charge status of approximately 33 percent, 5 approximately 67 percent, and 100 percent. Other configurations for the battery status indicator 74A are possible.

The Wi-Fi connection status indicator 74B can convey that the apparatus 10 is connected to Wi-Fi, and can be provided for a surface cleaning apparatus that is Wi-Fi enabled. In the illustrated example, the Wi-Fi connection status indicator 74B includes a light-emitting diode (LED) which illuminates when the apparatus 10 is connected to Wi-Fi. Other configurations for the Wi-Fi connection status indicator 74B are possible.

The clean water level status indicator 74C can convey the level or amount of clean water within the supply chamber 34. In the illustrated example, the clean water level status indicator 74C includes an LED array configured as a bar graph to indicate the level or amount of clean water in the supply chamber 34. Other configurations for the clean water level status indicator 74C are possible.

The dirty water level status indicator 74D can convey the level or amount of dirty water within the recovery tank container 64. In the illustrated example, the dirty water level status indicator 74D includes an LED array configured as a bar graph to indicate the level or amount of dirty water in the recovery tank container 64. Other configurations for the dirty water level status indicator 74D are possible.

The filter status indicator 74E can convey the status of a filter, such as the pre-motor filter 28. In the illustrated example, the filter status indicator 74E includes a LED which illuminates when the filter 28 needs replacement or cleaning. Other configurations for the filter status indicator 74E are possible.

The floor type status indicator 74F can convey the type of surface below the base 14, such as carpet, including different carpet pile heights like low carpet pile or high carpet pile, or bare floor such as wood, tile, or linoleum. The controller 76 may also be in communication with a manual override element allowing a user to manually set the floor type status, which is then displayed by the floor type status indicator 74F. In the illustrated example, the floor type status indicator 74F includes a light-emitting diode which illuminates when bare floors are detected. Other configurations for the floor type status indicator 74F are possible.

The self-cleaning status indicator 74G can convey that the apparatus 10 is in a self-cleaning mode, described above. In the illustrated example, the self-cleaning status indicator 74G includes a light-emitting diode which illuminates when the apparatus 10 is in the self-cleaning mode. Other configurations for the self-cleaning status indicator 74G are possible.

Figure 7:
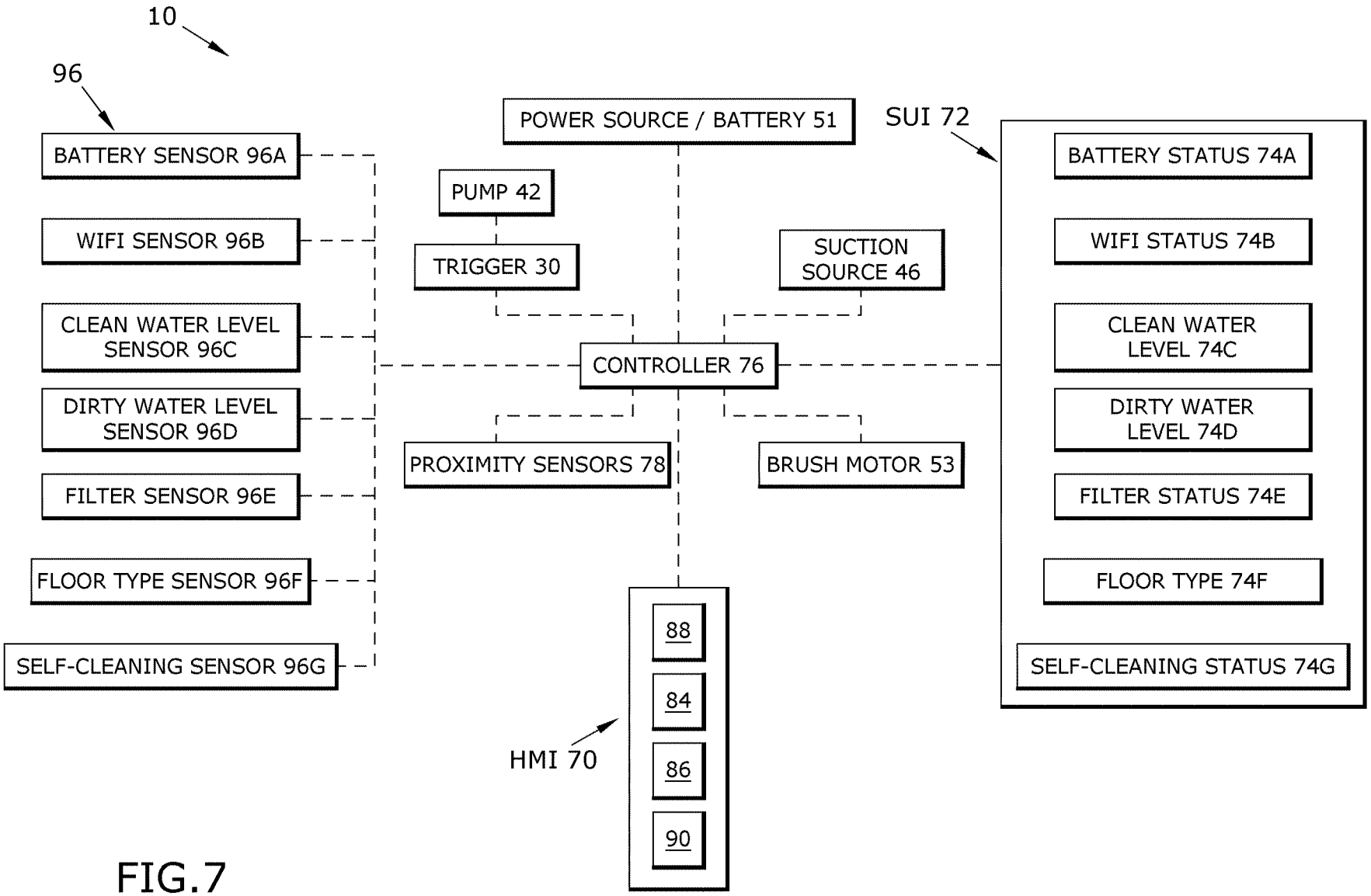
FIG. 7 is a schematic control diagram for the surface cleaning apparatus of FIG. 1.

FIG. 7 is a schematic control diagram for the surface cleaning apparatus 10. In addition to the at least one proximity sensor 78, the apparatus 10 can include at least one other status sensor 96 in communication with the controller 76. The status sensor 96 can provide input about at least one component of the apparatus 10, and the controller 76 can use the sensor input to control the operation of the surface cleaning apparatus 10. For instance, the controller 76 can use sensor input to provide one or more indicia about the status of the apparatus 10 to the user via the status indicators 74A-74G provided on the SUI 72.

In one embodiment, the apparatus 10 can include multiple status sensors 96 which can detect events or changes in its environment related to battery status, Wi-Fi connection status, clean water level, dirty water level, filter status, floor type, self-cleaning, or any number of other status information, and can transmit the information to the controller 76.

In the embodiment shown in FIG. 7, the sensors can include a battery sensor 96A, a Wi-Fi connection sensor 96B, a clean water level sensor 96C, a dirty water level sensor 96D, a filter sensor 96E, a floor type sensor 96F, and a self-cleaning mode sensor 96G.

The battery sensor 96A can detect the power capacity or charge level remaining within the battery 51. One example of a battery sensor 96A comprises a sensor module configured to measure the discharging and charging current, voltage, and temperature of the battery cells during operation. Other configurations for the battery sensor 96A are possible.

The Wi-Fi connection sensor 96B can detect the presence of a Wi-Fi network, signal strength, unique router identification data, or any combination thereof, and is configured to connect the apparatus 10 to the internet via a local Wi-Fi network. In one example, the Wi-Fi connection sensor 96B can comprise a Wi-Fi module for processing Wi-Fi signals and storing firmware, a Wi-Fi antenna for sending and receiving Wi-Fi signals, and optional LEDs for indicating power and Wi-Fi network connection status. Other configurations for the Wi-Fi connection sensor 96B are possible.

The clean water level sensor 96C can detect the level of clean water within the supply chamber 34. The clean water level sensor 96C can comprise a sensing element or apparatus immersed in fluid within the supply chamber 34, such as an electromechanical switch activated by a float, or one or more capacitive, ultrasonic, conductivity, resistive, or optical sensors configured to monitor fluid level within the supply chamber 34. Other configurations for the clean water level sensor 96C are possible.

The dirty water level sensor 96D can detect the level of dirty water within the recovery tank container 64. The dirty water level sensor 96D can comprise a sensing element or apparatus immersed in fluid within the recovery tank container 64, such as an electromechanical switch activated by a float, or one or more capacitive, ultrasonic, conductivity, resistive, or optical sensors configured to monitor fluid level within the tank container 64. Other configurations for the dirty water level sensor 96D are possible.

The filter sensor 96E can detect when a filter, such as the pre-motor filter 28, needs cleaning and/or replacement. One example of a suitable filter sensor 96E is an airflow sensor that detects a decrease in air velocity through the working air flow path of the apparatus 10. This type of sensor can detect a clogged condition of the filter 28, i.e. when the filter 28 becomes so soiled that air flow through the filter 28 is inhibited. Another example of a suitable filter sensor 96E is a pressure sensor that detects a drop in pressure in the working air flow path, which also detects a clogged condition of the filter 28. In yet another example, the filter sensor 96E can detect an operating time of the apparatus 10, and be configured to prompt the user to clean or replace the filter 28 after a predetermined operating time has elapsed. Other configurations for the filter sensor 96E are possible.

The floor type sensor 96F can detect the type of surface below the base 14, such as carpet, including different carpet pile heights like low carpet pile or high carpet pile, or bare floor such as wood, tile, or linoleum. In one example, the floor type sensor 96F can be provided on the base 14, and can comprise any one or combination of known sensor devices, such as, for example, an ultrasonic transducer, optical, acoustic, or mechanical sensor. Other configurations for the floor type sensor 96F are possible.

The self-cleaning mode sensor 96G can detect when the apparatus 10 is in a self-cleaning mode, described above. In one example, the self-cleaning mode sensor 96G can be a combination of feedback from components, e.g., voltage feedback from the storage tray 66 confirming the apparatus 10 is docked and a timer that starts after initiation of the self-cleaning mode via the button 88. Other configurations for the self-cleaning mode sensor 96G are possible.

FIGS. 8-11 illustrate one method of operating the proximity-triggered surface cleaning apparatus 10. The sequence of steps discussed is for illustrative purposes only and is not meant to limit the method in any way as it is understood that the steps may proceed in a different logical order, additional or intervening steps may be included, or described steps may be divided into multiple steps.

Figure 8:
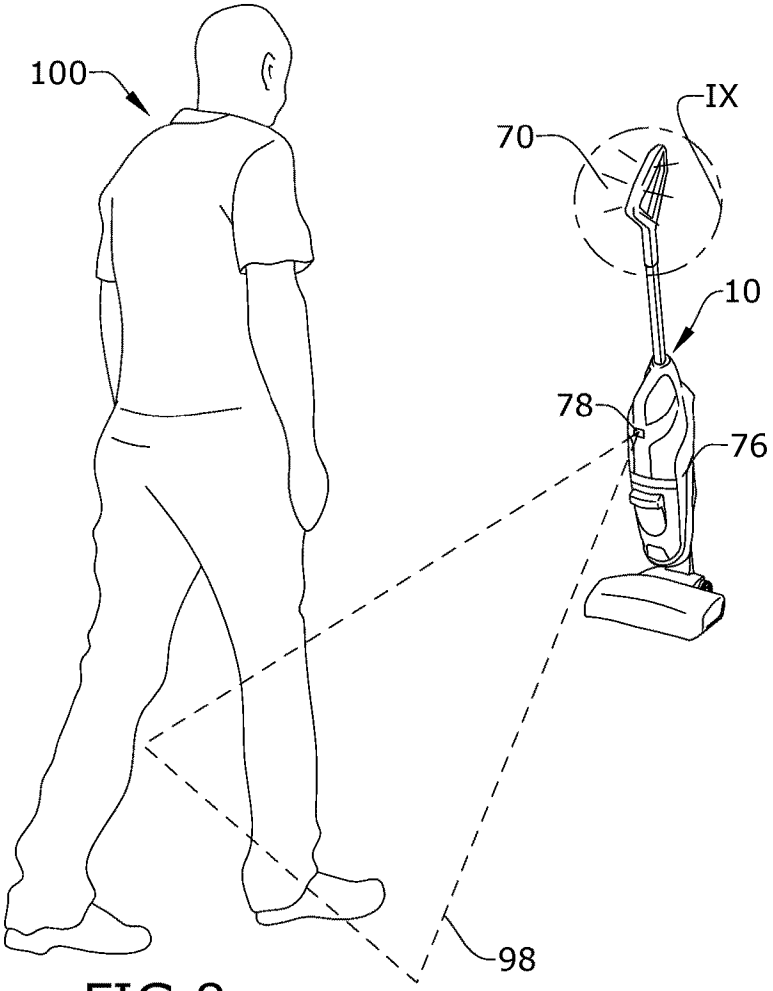
FIG. 8 illustrates a user approaching a proximity-triggered surface cleaning apparatus in accordance with a first method of operation.

Referring to FIG. 8, the area around the surface cleaning apparatus 10 can include at least one detection zone 98, in which the at least one proximity sensor 78 on the surface cleaning apparatus 10 can detect the presence of a nearby user 100 without any physical contact. In one embodiment, the proximity sensor 78 can more specifically detect the relative proximity of the user 100 to the surface cleaning apparatus 10.

Figure 9:
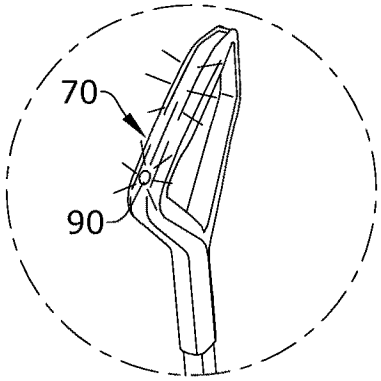
FIG. 9 illustrates a HMI for the surface cleaning apparatus of FIG. 8 illuminating in accordance with the first method of operation.

Initially, when a user enters the detection zone 98, the proximity sensor 78 can detect the user's presence and provide a signal to the controller 76, which can cause at least the HMI 70 to illuminate, including at least the SUI power button 90, as shown in FIG. 9.

Figure 11:
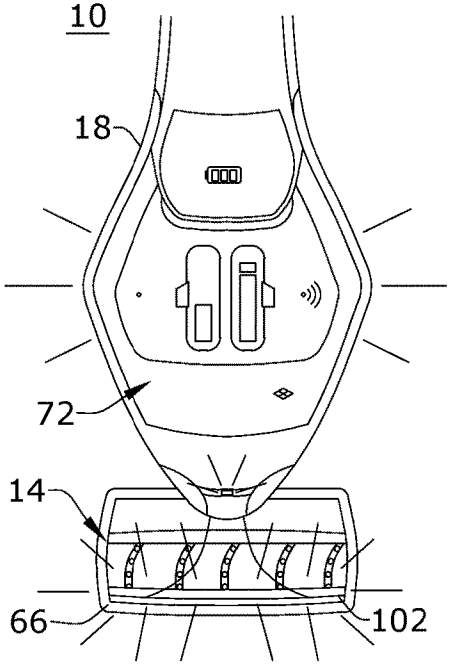
FIG. 11 illustrates a SUI for the surface cleaning apparatus of FIG. 8 illuminating in accordance with the first method of operation.
Figure 10:
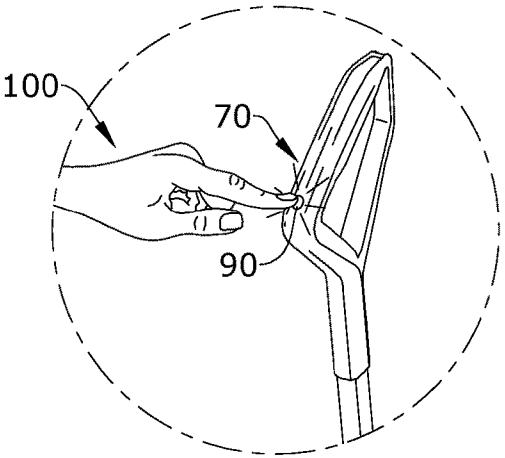
FIG. 10 illustrates the user interacting with the HMI of FIG. 9 in accordance with the first method of operation.

Referring to FIG. 10, if the user 100 continues to approach the surface cleaning apparatus 10 and presses the SUI power button 90, the SUI 72 can illuminate and can display status information via at least one status indicator 74, such as, but not limited to, battery status, Wi-Fi connection status, clean water level, dirty water level, filter status, floor type, self-cleaning, or any number of other status information, as shown in FIG. 11.

When the proximity sensor 78 signals the controller 76, the controller 76 further can ping onboard sensors, such as sensors 96A-96G described above with reference to FIG. 7, to obtain up-to-date status information, which is then displayed via SUI 72 if the user presses the SUI power button 90 as shown in FIG. 11. Alternatively, instead being triggered by user proximity, when the user 100 presses the SUI power button 90, the controller 76 can ping the onboard sensors to obtain up-to-date status information, which is then displayed by the SUI 72.

Optionally, as shown in FIG. 11, at least one of the base 14 or the storage tray 66 can include at least one light source 102 that emits light. For example, as shown herein, the base 14 can include at least one light source 102 which extends along a front side of the base 14. The light source 102 can be in the form of an LED array mounted on a PCB, optionally including at least one light pipe to transmit light across the entire width of the base 14.

The at least one light source 102 on the base 14 and/or storage tray 66 can illuminate based on the user's presence or based on manipulation of the HMI 70. In one example, when the user 100 presses the SUI power button 90, the at least one light source 102 can illuminate before, after, or simultaneously with the SUI 72. In an alternative example, the at least one light source 102 can illuminate when a user enters the detection zone 98. In this case, the proximity sensor 78 can detect the user's presence and provide a signal to the controller 76, which can cause at the at least one light source 102 to illuminate.

Figure 13:
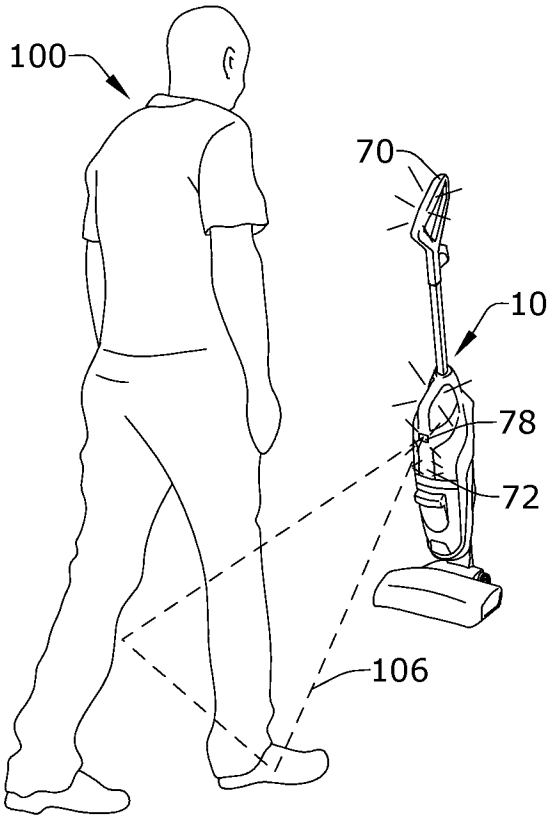
FIG. 13 illustrates a user continuing to approach the surface cleaning apparatus of FIG. 12 and a SUI illuminating in accordance with the second method of operation.
Figure 12:
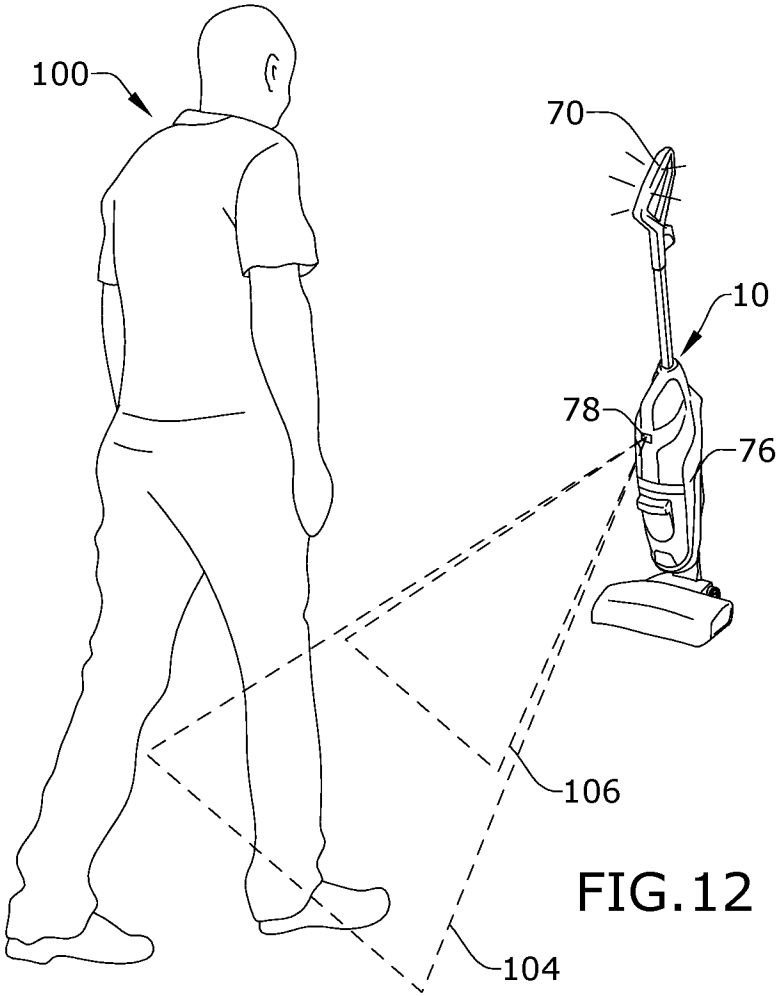
FIG. 12 illustrates a user approaching a proximity-triggered surface cleaning apparatus and a HMI illuminating in accordance with a second method of operation.

FIGS. 12-13 illustrate another method of operating the proximity-triggered surface cleaning apparatus 10. The sequence of steps discussed is for illustrative purposes only and is not meant to limit the method in any way as it is understood that the steps may proceed in a different logical order, additional or intervening steps may be included, or described steps may be divided into multiple steps.

Referring to FIG. 12, the area around the surface cleaning apparatus 10 can include multiple detection zones 104, 106, in which the at least one proximity sensor 78 on the surface cleaning apparatus 10 can detect the presence of a nearby user 100 without any physical contact. In one embodiment, the proximity sensor 78 can more specifically detect the relative proximity of the user 100 to the surface cleaning apparatus 10.

In one example, a first detection zone 104 and a second detection zone 106 can be located around the surface cleaning apparatus 10, with the first detection zone 104 being further away from the surface cleaning apparatus 10 (e.g. more than 2 feet away, including but not limited to up to—6 feet away) and the second detection zone 106 being closer to the surface cleaning apparatus 10 (e.g. within 2 feet).

Initially, when a user enters the first detection zone 104, farthest away from the apparatus 10, the at least one proximity sensor 78 can detect the user's presence and provide a signal to the controller 76, which can cause at least the HMI 70 to illuminate, as shown in FIG. 12. The controller 76 further can ping onboard sensors, such as sensors 96A-96G described above with reference to FIG. 7, to obtain up-to-date status information.

If the user 100 continues to approach the surface cleaning apparatus 10, which can be determined by the user 100 entering the second detection zone 106 as shown in FIG. 13, closer to the apparatus 10, the brightness of the illumination can increase, and the SUI 72 can illuminate and can display status information via at least one status indicator 74, such as, but not limited to, battery status, Wi-Fi connection status, clean water level, dirty water level, filter status, floor type, self-cleaning, or any number of other status information. While not shown in FIG. 13, the method can further include proximity-triggered illumination of the base 14 and/or storage tray 66, as described above with reference to FIG. 11.

Figure 14:
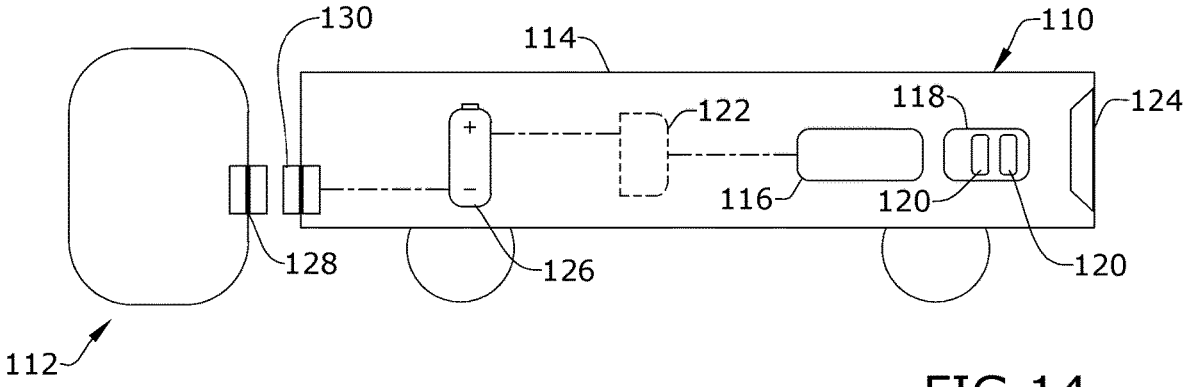
FIG. 14 is a schematic view of a system for an autonomous surface cleaning apparatus according to another aspect of the disclosure.

FIG. 14 is a schematic view of a system for an autonomous surface cleaning apparatus according to another aspect of the disclosure. The system can include an autonomous surface cleaning apparatus 110 and a docking station 112. As discussed in further detail below, the autonomous surface cleaning apparatus 110 is provided with a proximity-triggered user interface, including one or more status indicators which communicate information regarding the apparatus 110 to the user based on the proximity of the user. One example of a suitable autonomous surface cleaning apparatus 110 in which the various features and improvements described herein can be used is a deep cleaning robot which mounts the components of various functional systems of the deep cleaner in an autonomously moveable unit or housing 114, including at least a fluid delivery system for storing cleaning fluid and delivering the cleaning fluid to the surface to be cleaned, a fluid recovery system for removing the cleaning fluid and debris from the surface to be cleaned and storing the recovered cleaning fluid and debris. In another embodiment, the autonomous surface cleaning apparatus 110 can be a vacuum cleaning robot having a vacuum collection system for removing and collecting debris from the surface to be cleaned.

The deep cleaning robot 110 further includes a drive system for autonomously moving the robot 110 over the surface to be cleaned. The robot 110 can be configured to move randomly about a surface while cleaning the floor surface, using input from various sensors to change direction or adjust its course as needed to avoid obstacles, or, as illustrated herein, can include a navigation/mapping system for guiding the movement of the robot 110 over the surface to be cleaned. In one embodiment, the robot 110 includes a navigation and path planning system that is operably coupled with the drive system. The system builds and stores a map of the environment in which the autonomous vacuum cleaner 10 is used, and plans paths to methodically clean the available area. An artificial barrier system (not shown) can optionally be provided with the robot 110 for containing the robot 110 within a user-determined boundary.

The deep cleaning robot 110 can include at least one user interface through which a user can interact with the deep cleaning robot. The at least one user interface can enable operation and control of the robot 110 from the user's end, and can also provide feedback information from the robot 110 to the user. The at least one user interface can be electrically coupled with electrical components, including, but not limited to, circuitry electrically connected to various components of the fluid delivery and recovery systems of the robot 110.

In the illustrated embodiment, the robot 110 includes a human-machine interface (HMI) 116 having one or more input controls, such as but not limited to buttons, triggers, toggles, keys, switches, or the like, operably connected to systems in the robot 110 to affect and control its operation. The robot 110 also includes a status user interface (SUI) 118 having at least one status indicator 120 which communicates a condition or status of the robot 110 to the user. The at least one status indicator 120 can communicate visually and/or audibly. The HMI 116 and the SUI 118 can be provided as separate interfaces or can be integrated with each other, such as in a composite user interface, graphical user interface, or multimedia user interface. The robot 110 can further be provided with a speaker (not shown) for providing audible notifications to the user.

The robot 110 can further include a controller 122 operably coupled with the various function systems of the robot 110 for controlling its operation. The controller 122 can be a microcontroller unit (MCU) that contains at least one central processing unit (CPU).

The controller 122 is operably coupled with the HMI 116 for receiving inputs from a user and with the SUI 118 for providing one or more indicia about the status of the robot 110 to the user via the at least one status indicator 120, and can further be operably coupled with at least one sensor for receiving input about the environment and can use the sensor input to control the operation of the robot 110. For example, the controller 122 can be operably coupled with at least one proximity sensor 124 configured to detect the presence of a nearby user without any physical contact. In other words, a user need to physically touch the robot 110, including its housing 114, or the proximity sensor 124 for the user's presence to be registered by the controller 122. The at least one proximity sensor 124 can comprise any suitable configuration, including electromagnetic, ultrasonic, optical, or acoustic, for example. Examples of suitable proximity sensors include passive infrared (PIR) proximity sensors, microwave proximity sensors, ultrasonic proximity sensors, or photoelectric sensors.

In one example, the at least one proximity sensor 124 can be a sensor dedicated to detecting the presence of a nearby user without any physical contact. In another example, the at least one proximity sensor 124 can be a distance sensor for position sensing, and can be any sensor useful for providing measurements of distance or indications of proximity, including, but not limited to, infrared sensors, time-of-flight sensors, ultrasonic sensors, light detection and ranging (i.e. lidar) sensors, etc. Input from the distance sensor is used by the controller 122 to slow down and/or adjust the course of the robot 110 when objects are detected and can also be used to determine the distance to obstacles in front of the robot 110.

The docking station 112 can further be connected to a household power supply, such as a wall outlet, and can include a converter for converting the AC voltage into DC voltage for recharging a power supply 126 on-board the deep cleaning robot 110, which can be a rechargeable battery or battery pack, such as a lithium ion battery or battery pack. The docking station 112 can have charging contacts 128, and corresponding charging contacts 130 can be provided on the exterior of the robot 110, such as on the exterior of the housing 114. The docking station 112 can optionally include various sensors and emitters for monitoring robot status, enabling auto-docking functionality, communicating with the robot 110, as well as features for network and/or Bluetooth connectivity.

In one embodiment, the charging contacts 130 of the robot 110 are positioned opposite the sensor 124, such that the sensor 124 faces outward when the robot 110 is docked at the docking station 112 for charging. With this spatial relationship between the charging contacts 130 an the at least one sensor 132, when the robot 110 is on the docking station, the at least one proximity sensor 124, which can more specifically be at least one distance sensor, and can more specifically be at least one time-of-flight sensor, can detect a change in state in front of the robot 110, i.e. outwardly from the docking station 112, which would indicate a user approaching. The user interface, including at least one of the HMI 116, SUI 118, and/or the status indicator 120, can illumination in reaction to a user's detected approach.

Figure 15:
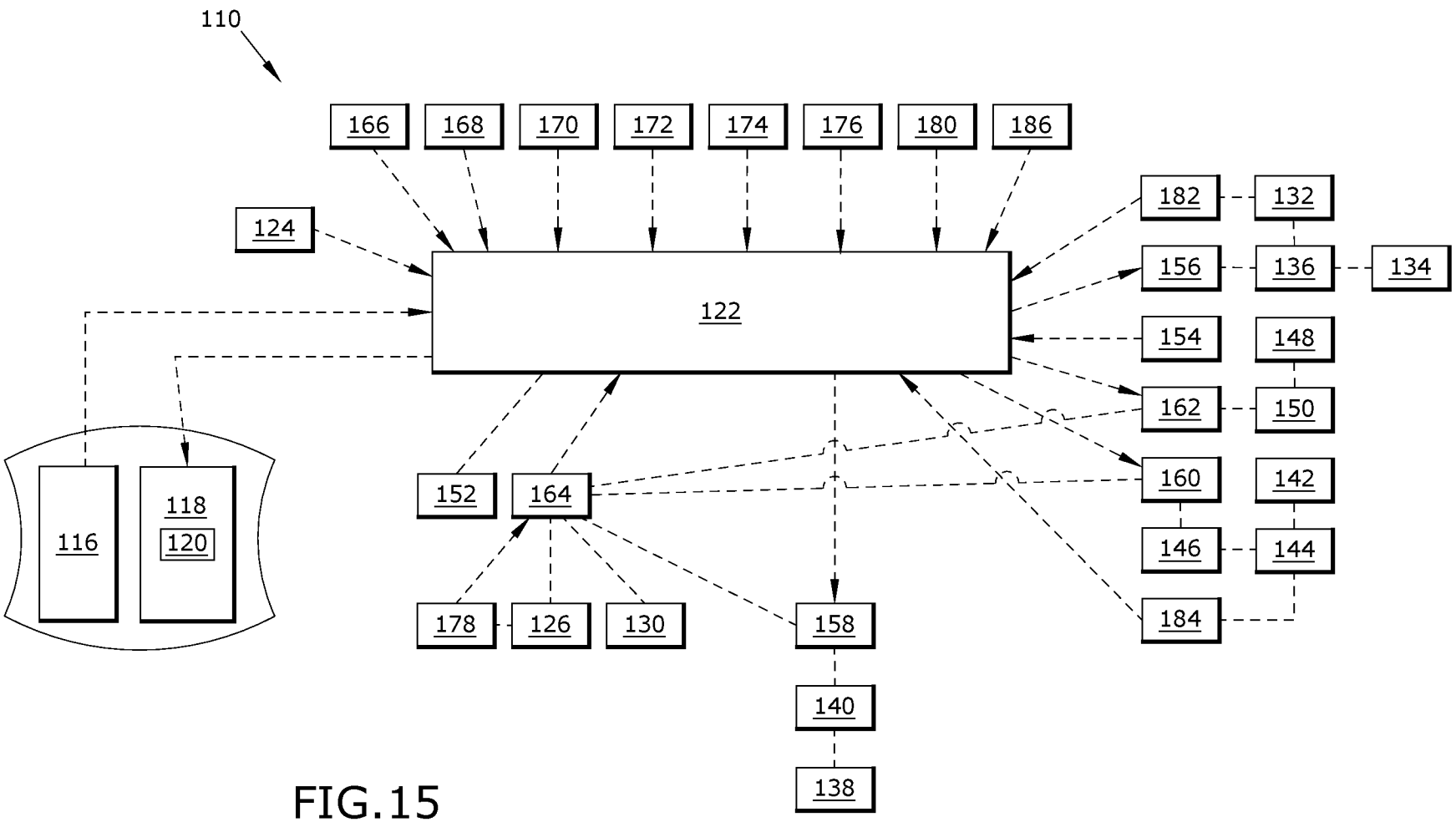
FIG. 15 is a schematic of one embodiment of an autonomous deep cleaner for use in the system of FIG. 14.
Figure 16:
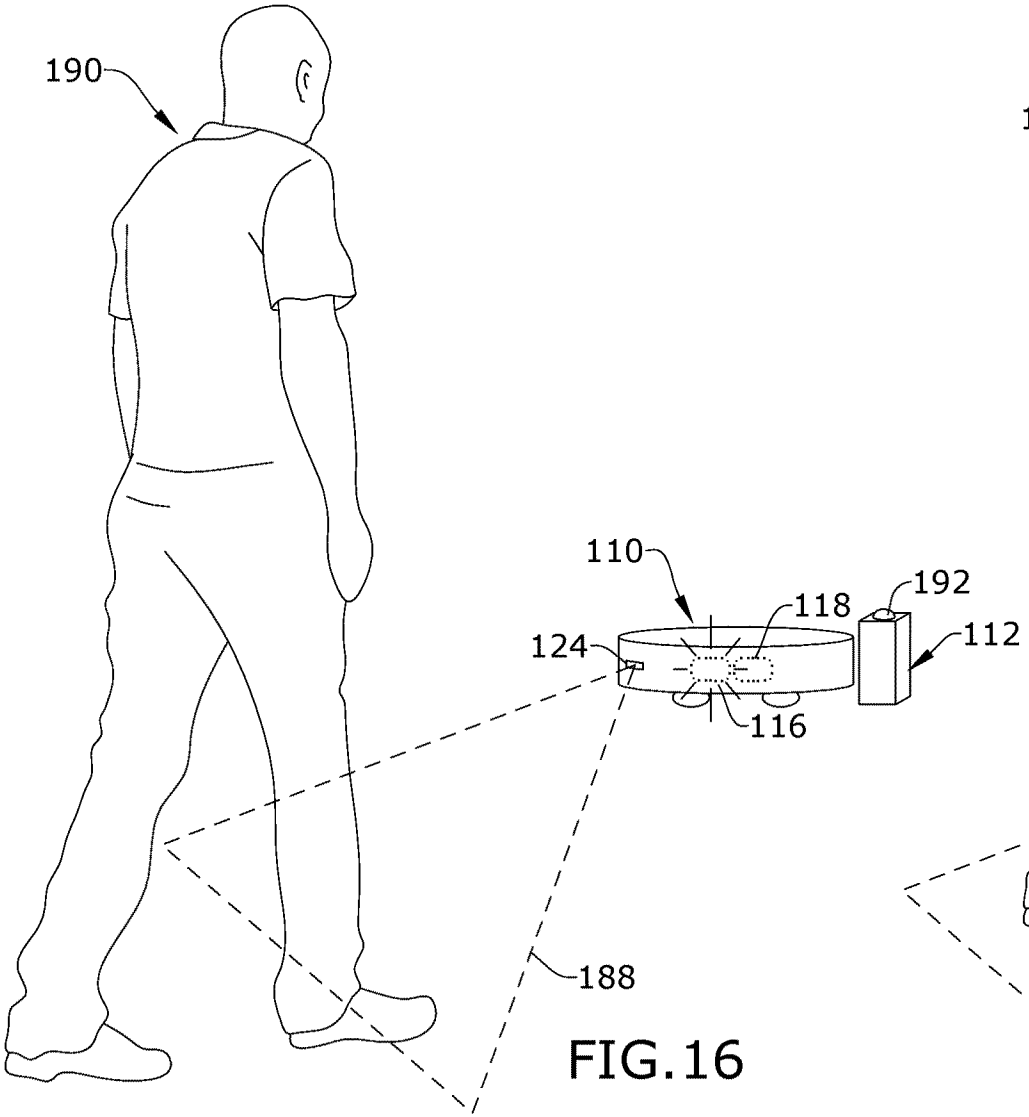
FIG. 16 illustrates a user approaching the proximity-triggered autonomous surface cleaning apparatus of FIG. 14 in accordance with a third method of operation.

FIG. 16 is a schematic view of one embodiment of the deep cleaning robot 110 of FIG. 15. It is noted that the robot 110 shown in FIG. 2 is but one example of a deep cleaning robot 110 that is usable with the system of FIG. 15.

The fluid delivery system can include a supply tank 132 for storing a supply of cleaning fluid and at least one fluid distributor 134 in fluid communication with the supply tank 132 for depositing a cleaning fluid onto the surface. The cleaning fluid can be a liquid such as water or a cleaning solution specifically formulated for carpet or hard surface cleaning. The fluid distributor 134 can be one or more spray nozzles provided on the housing 114 of the robot 110. Alternatively, the fluid distributor 134 can be a manifold having multiple outlets. A fluid delivery pump 136 is provided in the fluid pathway between the supply tank 132 and the fluid distributor 134 to control the flow of fluid to the fluid distributor 134. Various combinations of optional components can be incorporated into the fluid delivery system as is commonly known in the art, such as a heater for heating the cleaning fluid before it is applied to the surface or one more fluid control and mixing valves.

At least one agitator or brush 138 can be provided for agitating the surface to be cleaned onto which fluid has been dispensed. The brush 138 can be a brushroll mounted for rotation about a substantially horizontal axis, relative to the surface over which the robot 110 moves. A drive assembly including a separate, dedicated brush motor 140 can be provided within the robot 110 to drive the brush 138. Other embodiments of agitators are also possible, including one or more stationary or non-moving brushes, or one or more brushes that rotate about a substantially vertical axis.

The fluid recovery system can include an extraction path through the robot 110 having an extraction or suction nozzle 142 which is positioned to confront the surface to be cleaned and defines the air inlet, the recovery tank 144 for receiving dirt and liquid removed from the surface for later disposal, and a suction source 146 in fluid communication with the suction nozzle 142 and the recovery tank 144 for generating a working air stream through the extraction path. The suction source 146 can include a vacuum motor carried by the robot 110, and can define a portion of the extraction path. The recovery tank 144 can also define a portion of the extraction path and can comprise an air/liquid separator for separating liquid from the working airstream. Optionally, a pre-motor filter and/or a post-motor filter (not shown) can be provided as well.

The drive system can include drive wheels 148 for driving the robot 110 across a surface to be cleaned. The drive wheels 148 can be operated by a common drive motor or individual drive motors 150 coupled with the drive wheels 148 by a transmission, which may include a gear train assembly or another suitable transmission. The drive system can receive inputs from the controller 122 for driving the robot 110 across a floor, based on inputs from the navigation/mapping system. The drive wheels 148 can be driven in a forward or reverse direction in order to move the unit forwardly or rearwardly, and can be operated simultaneously or individually in order to turn the unit in a desired direction.

The controller 122 can receive input from the navigation/mapping system for directing the drive system to move the robot 110 over the surface to be cleaned. The navigation/mapping system can include a memory 152 that stores maps for navigation and inputs from various sensors, which is used to guide the movement of the robot 110. For example, wheel encoders 154 can be placed on the drive shafts of the wheel motors 150 and are configured to measure the distance travelled. This measurement can be provided as input to the controller 122.

Motor drivers 156, 158, 160, 162 can be provided for controlling the pump 136, brush motor 140, vacuum motor 146, and wheel motors 150, respectively, and act as an interface between the controller 122 and the components. The motor drivers 156-162 may be an integrated circuit chip (IC). For the wheel motors 150, one motor driver 162 can control the motors 150 simultaneously. The motor drivers 156-162 can be electrically coupled to a battery management system 164, which includes the rechargeable battery 126.

The controller 122 can further be operably coupled with various sensors for receiving input about the environment and can use the sensor input to control the operation of the robot 110. The sensor input can further be stored in the memory 152 and/or used to develop maps for navigation. The controller 122 can use sensor input to provide one or more indicia about the status of the robot 110 to the user via the at least one status indicator 120 provided on the SUI 118. In one embodiment, the robot 110 can include multiple sensors which can detect events or changes in its environment related to battery status, Wi-Fi connection status, clean water level, dirty water level, floor type, or any number of other status information, and can transmit the information to the controller 122.

In the illustrated example, the robot 110 can include a positioning or localization system having one or more sensors determining the position of the robot relative to objects. The localization system can include the at least one distance sensor 124 which doubles as a proximity sensor per the above discussion. The at least one distance sensor 124 can be mounted to the housing 114 of the robot 110, such as in the front of robot 110 to determine the distance to obstacles in front of the robot 110. Input from the sensor 124 can be used to slow down and/or adjust the course of the robot 110 when objects are detected, as well to for the proximity-triggered user interface as described in further detail below.

Some exemplary additional sensors are illustrated in FIG. 15, although it is understood that not all sensors shown may be provided, additional sensors not shown may be provided, and that the sensors can be provided in any combination. For example, the robot 110 are at least one cliff sensor 166 that provide distance feedback so that the robot 110 can avoid excessive drops such as stairwells or ledges, at least one bump sensor 168 for determining front or side impacts to the robot 110, at least one wall following sensor 170 that provides distance feedback so that the robot 110 can follow near a wall without contacting the wall, an accelerometer 172 which can be a nine-axis gyroscope or accelerometer to sense linear, rotational and magnetic field acceleration, and/or at least one lift-up sensor 174 which detect when the robot 110 is lifted off the surface to be cleaned, such as when the user picks up the robot 110.

The robot 110 can further include at least one floor condition sensor 176 for detecting a condition of the surface to be cleaned. For example, the robot 110 can be provided with an infrared dirt sensor, a stain sensor, an odor sensor, and/or a wet mess sensor. The floor condition sensor 176 provide input to the controller 122, which may direct operation of the robot 110 based on the condition of the surface to be cleaned, such as by selecting or modifying a cleaning cycle. The controller 122 can also direct the SUI 118 to provide a notification to the user, such as via the status indicator 120, of the detected floor condition.

The robot 110 can further include a battery sensor 178 which can detect the amount of charge left within the battery 126, a Wi-Fi connection sensor 180 which can detect whether the robot 110 is connected to a Wi-Fi network, a clean water level sensor 182 which can detect the level of clean water within the supply tank 132, a dirty water level sensor 184 which can detect the level of dirty water within the recovery tank 144, and/or a floor type sensor 186 which can detect the type of surface below the robot 110.

While not shown, the robot 110 can optionally include one or more sensors for detecting the presence of the supply and recovery tanks 132, 144. For example, one or more pressure sensors for detecting the weight of the tanks 132, 144 can be provided. This information is provided as an input to the controller 122, which may prevent operation of the robot 110 until the tanks 132, 144 are properly installed. The controller 122 can also direct the SUI 118 to provide a notification to the user, such as via the status indicator 120, that one or both of the tanks 132, 144 is missing.

Figure 17:
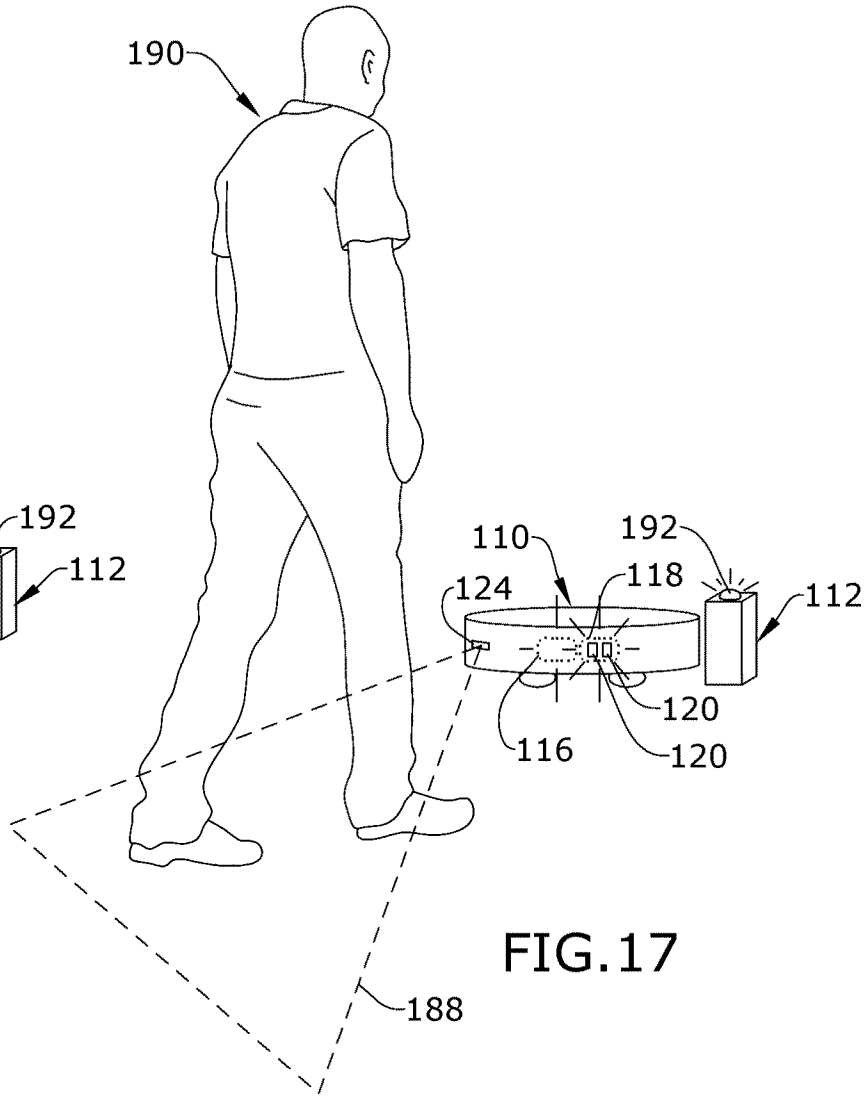
FIG. 17 illustrates a user continuing to approach the proximity-triggered autonomous surface cleaning apparatus of FIG. 14 and at least one status indicator illuminating in accordance with the third method of operation.

FIGS. 16-17 illustrate a method of operating the proximity-triggered robot 110. The sequence of steps discussed is for illustrative purposes only and is not meant to limit the method in any way as it is understood that the steps may proceed in a different logical order, additional or intervening steps may be included, or described steps may be divided into multiple steps.

Referring to FIG. 16, the area around the robot 110, which is docked at the docking station 112 can include at least one detection zone 188, in which the at least one proximity sensor 124, which may be a distance sensor, on the robot 110 can detect the presence of a nearby user 190 without any physical contact. In one embodiment, the proximity sensor 124 can more specifically detect the relative proximity of the user 190 to the robot 110.

Initially, when a user enters the detection zone 188, the proximity sensor 124 can detect the user's presence and provide a signal to the controller 122 (FIG. 15), which can cause one or both of the HMI 116 or the SUI 118 to illuminate, as shown in FIG. 16. The controller 122 further can ping onboard sensors, such as sensors 178-186 described above with reference to FIG. 15, to obtain up-to-date status information. Optionally, the brightness of the illumination can increase or ramp up upon continued approach of the user 190.

Referring to FIG. 17, if the user 190 continues to approach the robot 110, the SUI 118 can illuminate, if not already illuminated, and can display status information via at least one status indicator 120, such as, but not limited to, battery status, Wi-Fi connection status, clean water level, dirty water level, filter status, floor type, self-cleaning, or any number of other status information.

Optionally, as shown in FIG. 17, the docking station 112 can include at least one light source 192 that emits light. The at least one light source 192 on the docking station 112 can illuminate based on the user's presence. In one example, the at least one light source 192 can illuminate when a user 190 enters the detection zone 188, or when the user 190 reaches a certain distance from the robot 110 within the detection zone 188 as determined by the sensor 124.

In an alternative embodiment, one or both of the HMI 116 or the SUI 118 can illuminate when the proximity sensor 124 detects the user 190 within the detection zone 188, and the at least one status indicator 120 can illuminate and display status information upon a further user action, such as pressing a button on the HMI 116 or depressing a bumper of the robot 110, which can be detected by bump sensor 168 (FIG. 15).

In yet another alternative embodiment, instead of detecting the presence of a nearby user 190 without any physical contact, the robot 110 can be configured to detect the presence of a user, i.e. "wake up", when a user initiates physical contact with the robot 110. For example, when the robot 110 is docked on the docking station 112 and charging or otherwise dormant, such as in a "sleep" mode, a user can bump, tap, nudge or lift the robot 110 to actuate a sensor, such as the accelerometer 172, bump sensor 168, cliff sensor 166, or lift up sensor 174. The accelerometer 172, bump sensor 168, cliff sensor 166, or lift up sensor 174 can provide a signal to the controller 122, which can direct one or both of the HMI 116 or the SUI 118 to illuminate and display up-to-date status information via the status indicator 120. Thus, because the robot "wakes up" and provides status information in response to contact from a user, the user can avoid inadvertently initiating an unintended mode of operation by actuating the HMI 116.

The above described embodiments provide for a variety of benefits, including improved user interfaces for surface cleaning apparatus. These features, alone or in combination, create a superior user experience. An advantage that may be realized in the practice of some embodiments of the described surface cleaning apparatus with a proximity-triggered user interface is that the user of the apparatus is immediately able to see whether the apparatus is ready for operation, i.e. whether a supply chamber has sufficient solution, a recovery tank needs emptying, a filter needs cleaning, or the battery needs charging, etc. Another advantage that may be realized in the practice of some embodiments of the described surface cleaning apparatus with a proximity-triggered user interface is that a user does not have to bend down or press a button to turn the apparatus on to see status information.

To the extent not already described, the different features and structures of the various aspects or embodiments of the disclosure may be used in combination with each other as desired or may be used separately. That one surface cleaning apparatus is illustrated herein as having all of these features does not mean that all of these features must be used in combination, but rather done so here for brevity of description. Thus, the various features of the different embodiments may be mixed and matched in various vacuum cleaner configurations as desired to form new embodiments, whether or not the new embodiments are expressly described.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus for cleaning floor surfaces comprising:

a housing comprising a base adapted for movement across a floor surface to be cleaned and an upright handle assembly coupled with the base and comprising a handle including a handgrip;

at least one of:

a fluid delivery system comprising a supply tank assembly configured store cleaning fluid and a fluid distributor in fluid communication with the supply tank assembly and having at least one outlet for applying cleaning fluid to the floor surface to be cleaned; and a recovery system comprising a suction nozzle, a suction source in fluid communication with the suction nozzle, and a recovery tank assembly configured store cleaning fluid and debris collected from the floor surface to be cleaned;

a controller;

at least one status sensor in communication with the controller and configured to provide input about a component of the apparatus;

a proximity sensor operably coupled with the controller and configured to detect the presence of a user within at least one detection zone when the surface cleaning apparatus is not in active operation and without physical contact of the user with the housing or the proximity sensor; and a proximity-triggered user interface on the upright handle assembly and configured to receive input from the controller, wherein the user interface is configured to provide at least one indicia to the user when the surface cleaning apparatus is not in active operation in response to detection of the presence of the user within the at least one detection zone by the proximity sensor;

wherein the at least one indicia is based at least on part on input from the at least one status sensor.

2. The surface cleaning apparatus of claim 1, wherein the user interface comprises a status indicator which visually conveys a status of the surface cleaning apparatus to the user, and the at least one indicia comprises status information displayed via the status indicator.

3. The surface cleaning apparatus of claim 1, wherein the user interface comprises a power button and a light source that emits light, and the at least one indicia provided to the user comprises illumination of the power button when the surface cleaning apparatus is not in active operation in response to detection of the presence of the user within the at least one detection zone by the proximity sensor.

4. The surface cleaning apparatus of claim 3, wherein:

the user interface comprises a status indicator which communicates a status of the surface cleaning apparatus to the user; and the user interface is configured to display status information via the status indicator upon user-selection of the power button.

5. The surface cleaning apparatus of claim 4, wherein, upon detection of the user within the at least one detection zone, the controller is configured to obtain up-to-date status information from the at least one status sensor and display the up-to-date status information via the status indicator upon user-selection of the power button.

6. The surface cleaning apparatus of claim 1, wherein the proximity sensor is configured to detect the presence of a user within at least a first detection zone and a second detection zone, wherein the user interface is configured to issue a first indicia when a user is detected within the first detection zone and to issue a second indicia, different from the first indicia, when a user is detected within the second detection zone.

7. The surface cleaning apparatus of claim 6, wherein:

the user interface comprises a light source that emits light and a status indicator which communicates a status of the surface cleaning apparatus to the user;

the first indicia comprises illumination of the light source; and the second indicia comprises status information displayed via the status indicator.

8. The surface cleaning apparatus of claim 6, wherein:

the user interface comprises a human-machine interface and a status user interface having a status indicator that communicates a status of the surface cleaning apparatus to the user;

the first indicia comprises illumination of the human-machine interface, without illumination of the status user interface; and the second indicia comprises illumination of the status user interface.

9. The surface cleaning apparatus of claim 8, wherein:

upon detection of the user within the first detection zone, the controller is configured to obtain up-to-date status information from the at least one status sensor; and upon detection of the user within the second detection zone, the controller is configured to display the up-to-date status information via the status indicator.

10. The surface cleaning apparatus of claim 6, wherein:

the proximity sensor is configured to detect the presence of a user within at least a first detection zone and a second detection zone that is closer to the surface cleaning apparatus than the first detection zone;

upon detection of the user within the first detection zone, the controller is configured to obtain up-to-date status information from the at least one status sensor; and upon detection of the user within the second detection zone, the controller is configured to display the up-to-date status information via the status indicator.

11. The surface cleaning apparatus of claim 1 comprising a battery within the housing and electrically coupled to at least one electrical component, wherein:

the at least one status sensor comprises a battery sensor configured to detect a power capacity or charge level remaining within the battery; and the at least one indicia comprises a battery status indicator on the user interface that is configured to communicate the amount of charge left within the battery.

12. The surface cleaning apparatus of claim 1 comprising the fluid delivery system and the recovery system, wherein:

the at least one status sensor comprises a clean water level sensor configured to detect a level of water within the supply tank assembly and a dirty water level sensor configured to detect a level of water within the recovery tank assembly; and the at least one indicia comprises a clean water level status indicator on the user interface that is configured to communicate the level of water within the supply tank assembly and a dirty water level status indicator on the user interface that is configured to communicate the level of dirty water within the recovery tank assembly when the user is detected within the at least one detection zone.

13. The surface cleaning apparatus of claim 1 comprising the recovery system and a filter provided in a working air path of the recovery system, wherein:

the at least one status sensor comprises a filter sensor configured to detect a status of the filter; and the at least one indicia comprises a filter status indicator on the user interface that is configured to communicate whether the filter needs replacement or cleaning when the user is detected within the at least one detection zone.

14. The surface cleaning apparatus of claim 1 wherein the at least one status sensor comprises a floor type sensor configured to detect a type of surface below the apparatus, and wherein the at least one indicia comprises a floor type status indicator on the user interface that is configured to communicate the type of surface when the user is detected within the at least one detection zone.

15. The surface cleaning apparatus of claim 1 comprising a self-cleaning mode for cleaning at least one component of the apparatus, wherein:

the at least one status sensor comprises a self-cleaning mode sensor configured to detect when the apparatus is in the self-cleaning mode; and the at least one indicia comprises a self-cleaning status indicator on the user interface that is configured to communicate whether the surface cleaning apparatus is in the self-cleaning mode when the user is detected within the at least one detection zone.

16. The surface cleaning apparatus of claim 1, wherein the user interface comprises a human-machine interface and a status user interface having at least one status indicator that communicates a condition or status of the apparatus to a user, and wherein the human-machine interface and the status user interface are physically separate from each other.

17. The surface cleaning apparatus of claim 1, wherein the base comprises a light source that emits light, wherein the controller is configured to illuminate the light source when the surface cleaning apparatus is not in active operation in response to detection of the presence of the user within the at least one detection zone by the proximity sensor.

18. The surface cleaning apparatus of claim 1 comprising multiple proximity sensors, wherein the upright handle assembly comprises a frame, with a lower end of the frame coupled with the base, and wherein the multiple proximity sensors includes a first proximity sensor located in the handgrip of the handle and configured to detect the presence of a user without physical contact of the user with the handgrip and second proximity sensor located in the frame of the upright handle assembly and configured to detect the presence of a user without physical contact of the user with the frame.

19. The surface cleaning apparatus of claim 1, wherein:

the upright handle assembly comprises the controller, the proximity sensor, and the proximity-triggered user interface; and the proximity sensor comprises a field of view that defines the at least one detection zone, wherein the field of view is at least 180 degrees and covers an area in front of the surface cleaning apparatus.

20. The surface cleaning apparatus of claim 1 wherein:

the upright handle assembly comprises a frame coupled with the base and a handle including a handgrip;

the proximity sensor is located in one of the handgrip and the frame;

the proximity-triggered user interface comprises a display on the frame and comprises at least one of a battery status indicator, a clean water level status indicator, a dirty water level status indicator, a filter status indicator, and a self-cleaning status indicator; and the at least one status sensor comprises at least one of a battery sensor, a clean water level sensor, a dirty water level sensor, a filter sensor, and a self-cleaning mode sensor.

* * * * *